US006298215B1

(12) United States Patent
Nomura et al.

(10) Patent No.: US 6,298,215 B1
(45) Date of Patent: Oct. 2, 2001

(54) IMAGE HEATING APPARATUS

(75) Inventors: Takashi Nomura, Numazu; Hideo Nanataki, Yokohama; Tetsuya Sano, Shizuoka-ken; Takao Kume, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/651,246

(22) Filed: Aug. 30, 2000

(30) Foreign Application Priority Data

Aug. 31, 1999 (JP) ..... 11-245268

(51) Int. Cl.[7] ..... G03G 15/00; H05B 1/00

(52) U.S. Cl. ..... 399/328; 219/619; 399/329; 399/334

(58) Field of Search ..... 219/216, 619; 399/45, 69, 328, 329, 334

(56) References Cited

U.S. PATENT DOCUMENTS 4,801,968 * 1/1989 Kogure et al. ..... 399/328
5,204,723 * 4/1993 Kanada et al. ..... 399/328
6,185,383 * 2/2001 Kanari et al. ..... 399/45

FOREIGN PATENT DOCUMENTS 51109736 9/1976 (JP) .
11258939 9/1999 (JP) .

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

The present invention provides an image heating apparatus which has a rotary member, magnetic flux generating device for generating a magnetic flux, and wherein an eddy current is generated in the rotary member by the magnetic flux generated by the magnetic flux generating device, the rotary member generates heat by the eddy current and an image on a recording material is heated by the heat, a heat conducting member being in contact with the rotary member, wherein, when, with respec to a direction perpendicular to a moving direction of the rotary member, $L_h$ being a length of a heat generating region of the rotary member, $L_f$ being a length of the rotary member, and L being length of the heat conducting member, $L_h \leqq L \leqq L_f$ is satisfied.

11 Claims, 15 Drawing Sheets

IMAGE HEATING APPARATUS

BACKGROUND OF THE INVENTION

1. Field of the Invention

The present invention relates to an image heating apparatus which is applied to an image forming apparatus of a copier and a printer, etc. and in particular to an apparatus having a rotary member which generates heat due to inductive heating.

2. Related Background Art

For convenience, in an image forming apparatus such as a copier and a printer, etc., an image heating apparatus (a fixing apparatus) which implements heat-fixing a toner image onto a recording material will be described as an example.

In an image forming apparatus, an apparatus involving a thermal roller is widely used as a fixing apparatus that heat-fixes an appropriate image forming processing means such as an electrophotographic process, an electrostatic recording process, and a magnetic recording process, etc. that have caused an unfixed image (a toner image) for target image information formed and carried onto a recording material (transferring material sheet, electrofax sheet, electrostatic recording paper, OHP sheet, print paper, and a format paper, etc.) by way of a transferring method or direct method as a permanent fixed image onto a recording material.

In addition, in recent years, an apparatus of a heater contact type film heating system, that is advantageous for the purpose of pursuing energy saving or shortening of wait time, etc., has become practically available.

Moreover, an apparatus of an electromagnetic inductive heating system is likewise proposed as the one which improves thermal efficiency. Japanese Utility Model Application Laid-Open No. 51-109736 has disclosed an inductive heating fixing apparatus which causes the magnetic flux to induce current in a fixing roller and generates heat with Joule heat. This directly causes the fixing roller to generate heat in use of generation of the inductive current so as to attain a fixing process with efficiency higher than that in a fixing apparatus of a thermal roller system using a halogen lamp as a heat source.

With alternate magnetic flux by way of excitation coil as magnetic filed generating means, the cylindrical fixing film itself as an inductive heating rotary body is caused to generate heat so that a fixing process is implemented.

In FIG. 16, a horizontal sectional view of a model as an example of a fixing apparatus of an electromagnetic inductive heating system being a background art of the present invention is shown.

Reference numeral 9 denotes a cylindrical fixing film as an electromagnetic inductive heating rotary body, and has inside its thickness an electromagnetic inductive heating layer (a conductive material layer, a magnetic body layer, and a resistant body layer).

Reference numeral 11 is a film guide member having a horizontally sectional view of an approximately semicircle resembling a gutter, and the above described cylindrical fixing film 9 is fitted externally and loosely from outside this film guide member 11.

Inside this film guide member 11, magnetic field generating means comprising magnetic cores (core materials) 13*a* and 13*b* forming a T with the magnetizing coil 12 are disposed.

The reference numeral 10 denotes an elastic pressing roller, which together with the lower surface of the film guide member 11 sandwiches the fixing film 9 and forms a fixing nip section N of a predetermined width with a predetermined pressure-contact force to be in pressure-contact with each other.

Pressing roller 10 is rotary-driven counterclockwise in the direction of the arrow. Rotary operation of this pressing roller 10 gives rise to the friction force between the above described pressing roller 10 and the outer surface of the fixing film 9, which force apply the rotary force to the fixing film 9, and the above described fixing film 9 having its inner surface to slide in tight contact with the lower surface of the film guide member 11 is rotary-driven around the exterior of the film guide member 11 with a peripheral velocity approximately corresponding with the rotary peripheral velocity of the pressing roller 10 in the fixing nip section N clockwise along the arrow (the pressing roller drive system).

The film guide member 11 has its role to attain the support of the excitation coil 12 and the magnetic cores 13*a* and 13*b* as pressing means onto the fixing nip section N as well as magnetic field generating means, the support of the fixing film 9, and the stability of conveyance at the time when the above described film 9 rotates. This film guide member 11 is an insulating member that does not prevent the magnetic flux from passing, and materials enduring heavy loads are used.

The temperature of the fixing nip section N is detected by a temperature detection means 18 which are brought into contact with the fixing film 9, and based thereon, current supply toward the excitation coil 12 is controlled so that temperature control is implemented to maintain a predetermined temperature.

And in addition, under the state where the pressing roller 10 undergo rotary operation, accompanied by which the cylindrical fixing film 9 rotates around the exterior of the film guide member 11, and feeding from the excitation circuit to the excitation coil 12 gives rise to electromagnetic inducted heating on the fixing film 9 as described above and the temperature of the fixing nip section N rises up to a predetermined temperature and is subject to the temperature control, the recording material P in which an unfixed toner image t is formed in the not shown image forming means section is introduced so that the image surface is caused to face upward, that is, against the fixing film surface between the fixing film 9 of the fixing nip section N and the pressing roller 10, and is sandwiched under such a state that the above described image surface is brought into tight contact with the outer surface of the fixing film 9 so as to be conveyed inside the above described fixing nip section N together with the fixing film 9.

In this process where the fixing nip section N is being conveyed, the unfixed toner image t on the recording material P undergoes heating with the electromagnetic inducted heating of the fixing film 9 so as to under heating fixing. When the recording material P passes through the fixing nip section N, it will be separated from the outer surface of the rotary fixing film 9 and be discharge-conveyed.

In such fixing apparatus of the electromagnetic inducted system as described above in FIG. 16, in which the fixing film 9 generates heat, the heat capacity of the fixing film 9 is, in particular, small and thin in thickness and therefore the coefficient of thermal conductivity of the above described fixing film 9 in the longitudinal direction is low. Thus, in the case where a recording material with width narrower than the fixing film 9 is caused to pass through, since the heat in the portion (of the non-sheet passing portion) where the recording material does not pass through is not deprived, the temperature of the fixing film in the above described sheet passing portion will rise (thermal rise in the non-sheet passing portion).

Therefore, for example, in the case where subsequent to a small size paper such as an envelope a sheet of A-4 size undergo printing, the temperature of the non-sheet passing portion after a sheet of small size paper has past through reaches the offset temperature of the toner, and therefore there gave rise to a problem that when a sheet of paper in A4 size passes through the toner on the A4 size sheet undergoes offsetting on the fixing film and good fixing image becomes unavailable.

Thus, in order to solve this non-sheet passing portion temperature rise, there is a method in which the throughput is decreased so that the number of sheets to be fed in a minute is largely decreased, which, however, was not advisable in the present times when high-speed printing is called for.

Under the circumstances, the present applicant has proposed a theory that the rotary body is brought into contact with a thermal conductive member so that the thermal difference in the rotary body in the longitudinal direction is controlled in Japanese Patent Application Laid-Open No. 11-258939.

However, there was a case where thermal efficiency dropped with a certain length in the thermal conductive member or the temperature at an end section was caused to drop.

SUMMARY OF THE INVENTION

The object of the present invention is to provide an image heating apparatus that removes thermal unevenness between in the sheet passing portion and in the non-sheet passing portion while preventing drops in thermal efficiency as well as temperature drops at an end section.

Another object of the present invention is to provide an image heating apparatus comprising rotary member, magnetic flux generating means for generating a magnetic flux, heat conducting member being contact with the rotary member, an eddy current is generated in the rotary member by a magnetic flux generated by the flux generating means, the rotary member generates heat with this eddy current, an image on a recording material is heated with this heat, and, when, with respect to a direction perpendicular to a moving direction of the rotary member, $L_h$ being length of heat generating region of the rotary member, $L_f$ being length of the rotary member, and L being length of the heat conducting member, $L_h \leqq L \leqq L_f$ is satisfied.

Further objects of the present invention will become obvious in the following description.

DETAILED DESCRIPTION OF THE PREFERRED EMBODIMENTS

Embodiments of the present invention will be described as follows with reference to the drawings.

<Embodiment 1> (FIG. 1 to FIG. 7 and FIGS. 8A and 8B)

(1) Example of image forming apparatus

Figure 1:
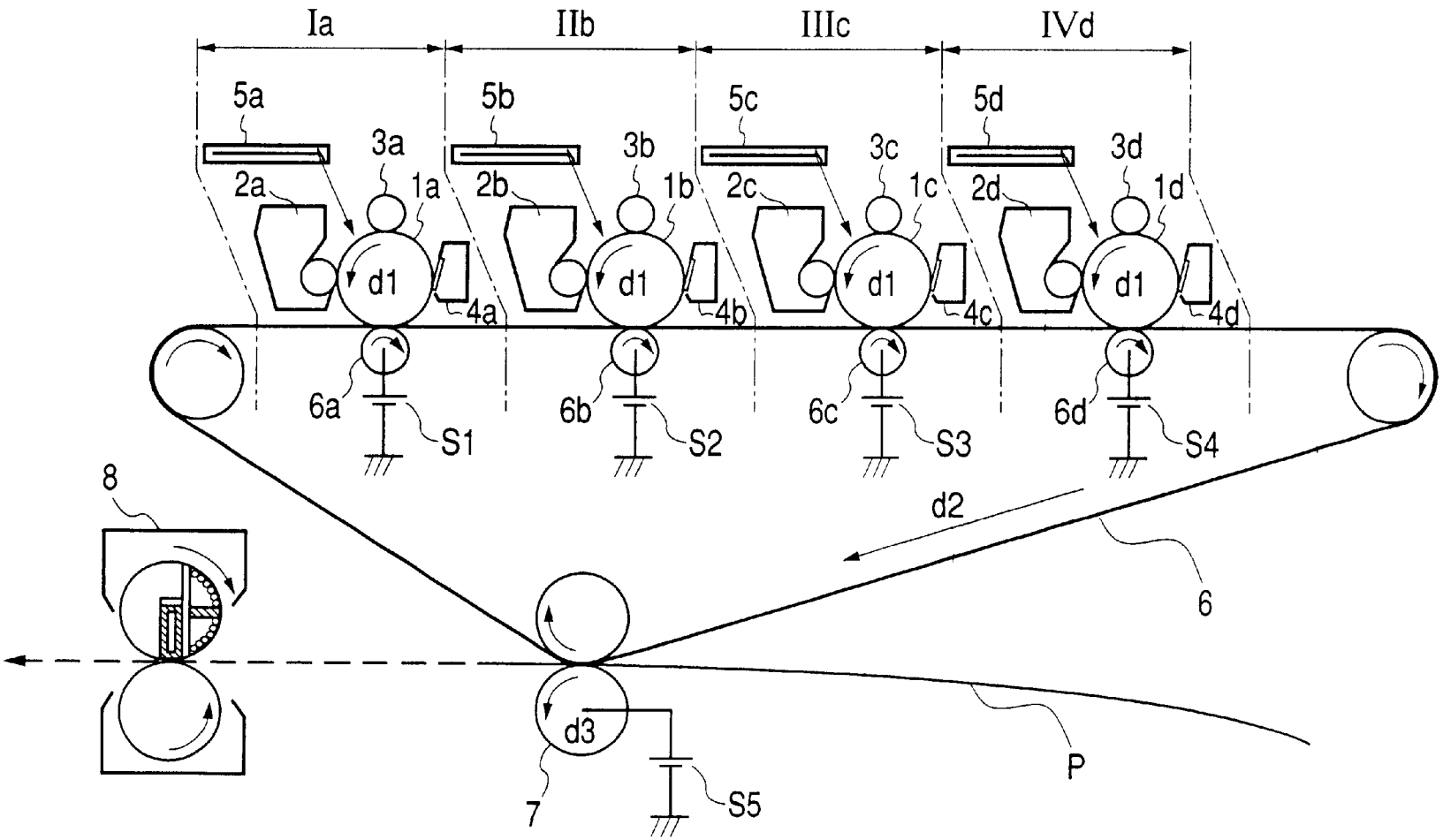
FIG. 1 is a drawing showing an image forming apparatus to which an image heating apparatus being an embodiment of the present invention is applied.

FIG. 1 is a schematic view showing a sectional view of a color laser-beam printer (an image forming apparatus) using an electrophotographic process. The color laser-beam printer of this embodiment uses an intermediate transfer belt as an intermediate transfer body, and has a first to a fourth image forming units (stations) Ia, IIb, IIIc, and IVd for respective color components of a first color (yellow), a second color (magenta), a third color (cyan), and a fourth color (black) respectively, and each of the first to fourth image forming units Ia, IIb, IIIc, and IVd comprises a developing device, an exposing means, an image bearing body (hereinafter to be referred to as "photosensitive drum"), a charging device, and cleaning means, etc. respectively.

In the first image forming unit Ia, the photosensitive drum 1*a,* which is rotary-driven at a predetermined peripheral velocity in the direction of the arrow d1, gets uniformly charged with the primary charging roller 3*a* and receives via the image formation exposing optics system the laser beam modulated corresponded with the digital image signals scanned from the laser scanner 5*a* so that electrostatic latent image of the first color component (the yellow component) is formed. Subsequently, in a developing device 2*a,* with a yellow toner Y the electrostatic latent image is developed so that a visible image corresponding to a component image of the first color (yellow) is formed in the photosensitive drum 1*a.*

An image creating operation similar to the above described procedure is executed in the second to the forth image forming units IIb, IIIc, and IVd as well so that visible images respectively corresponding to component images of the second color (magenta), the third color (cyan), and the fourth color (black) are formed in the photosensitive drums 1*b,* 1*c,* and 1*d* of the respective units.

An intermediate transferring belt 6 is rotary-driven at the same peripheral velocity as the photosensitive drums 1*a,* 1*b,* 1*c,* and 1*d* of the respective image forming units in the direction of the arrow symbol d2.

The transfer of the yellow visible image (the primary transfer) from the photosensitive drum 1*a* of the first image forming unit 1*a* to the intermediate transferring belt 6 is implemented by applying the primary transferring bias supplied by the power S1 onto the transferring roller 6*a*.

Also using the similar means, the magenta visible image, the cyan visible image, and the black visible image from the respective photosensitive drums 1*b*, 1*c*, and 1*d* to the intermediate transferring belt 6 in the second to the fourth image forming units IIb, IIIc, and IVd are sequentially overlapped onto the intermediate transferring belt 6 to undergo the primary transfer so that a color image is obtained.

In the nip section with the secondary transferring roller 7, the color toner image formed onto the intermediate transferring belt 6 undergoes a bulk transfer (a secondary transfer) onto a recording material P being a member to be heated which is sheet-fed at a predetermined control timing from a not-shown sheet feeding section to the above described nip section.

The recording material P that has undergone the secondary transfer of the color image is conveyed to a fixing apparatus 8 so that a color image is fixed with heat and pressure in the fixing nip section.

(2) Fixing apparatus 8

Figure 2:
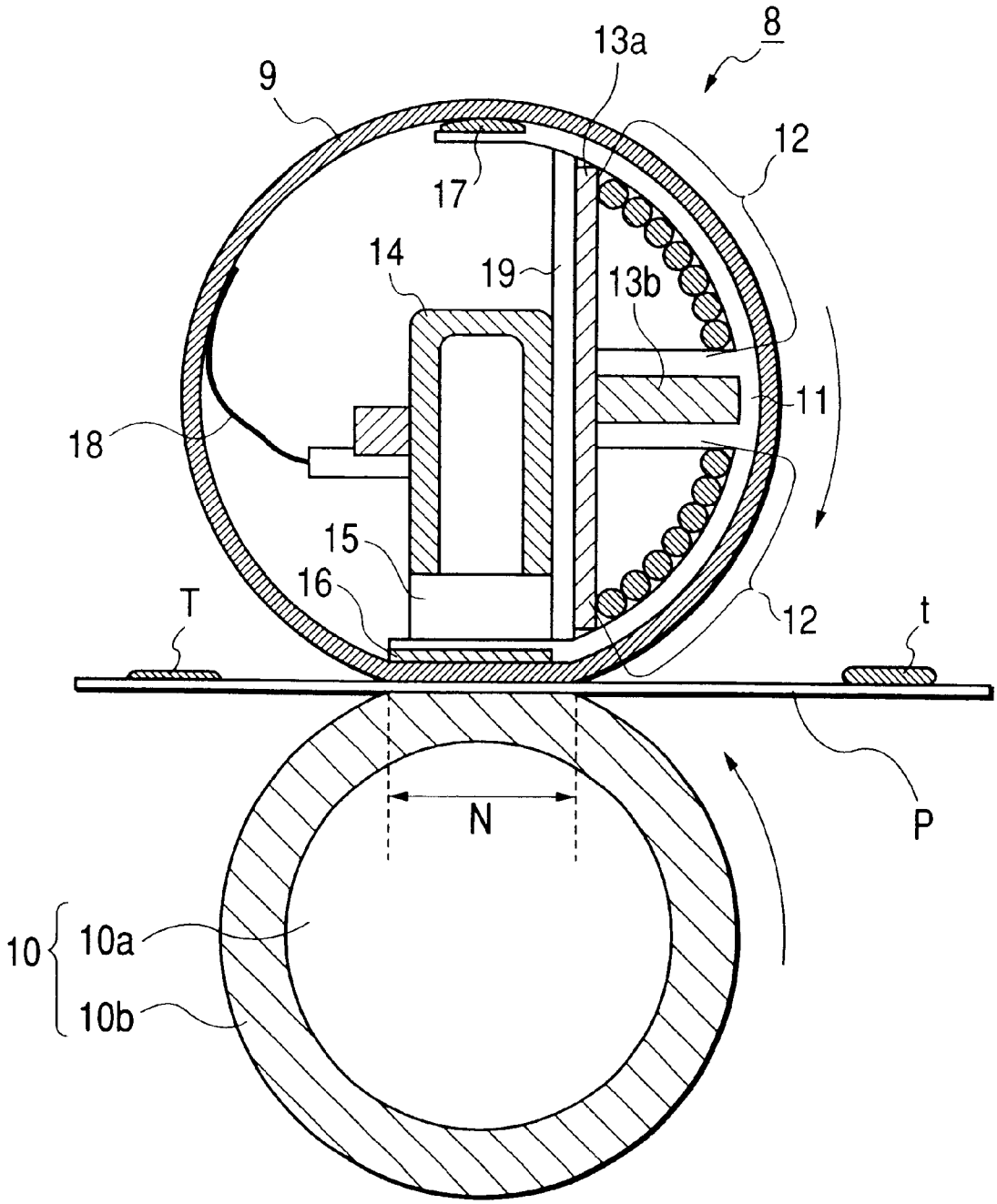
FIG. 2 is a drawing showing an image heating apparatus being an embodiment of the present invention.
Figure 3:
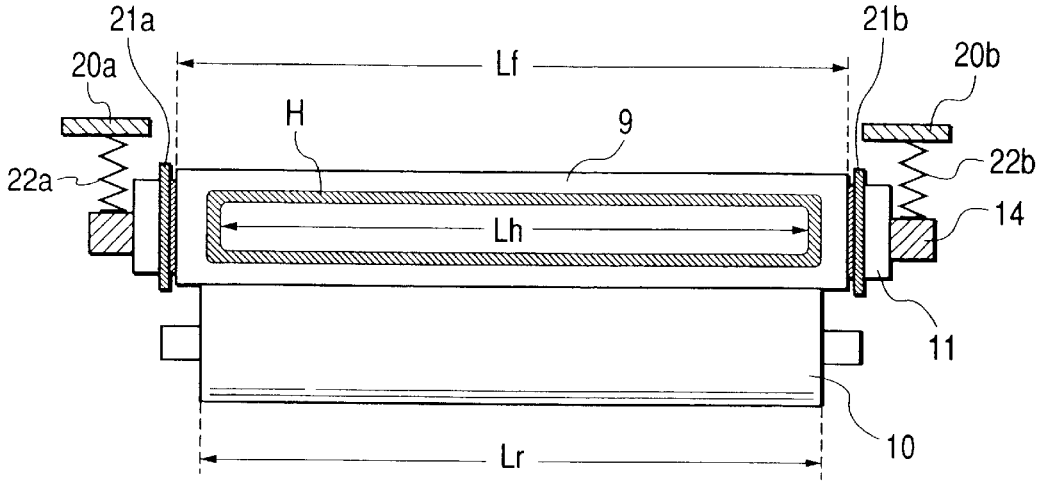
FIG. 3 is a front view of an image heating apparatus.
Figure 4:
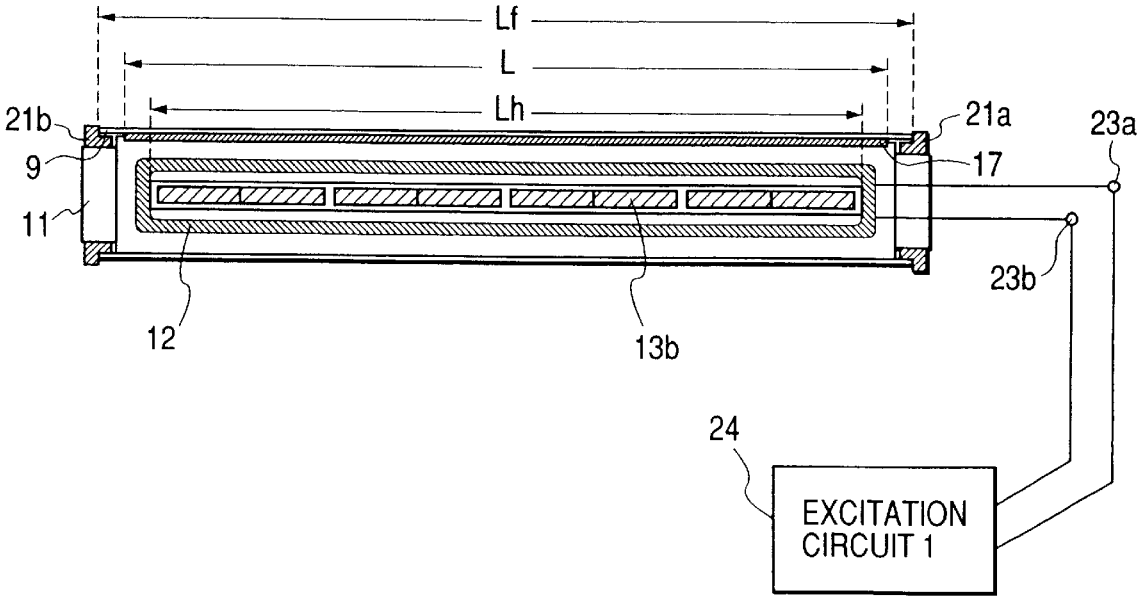
FIG. 4 is a front sectional view of an image heating apparatus.

FIG. 2 is a horizontal sectional model view of the fixing apparatus 8 in this embodiment, FIG. 3 is a front model view observed from the sheet feeding side, and FIG. 4 is a vertical sectional model view of the key portion observed from the sheet discharging side.

Figure 16:
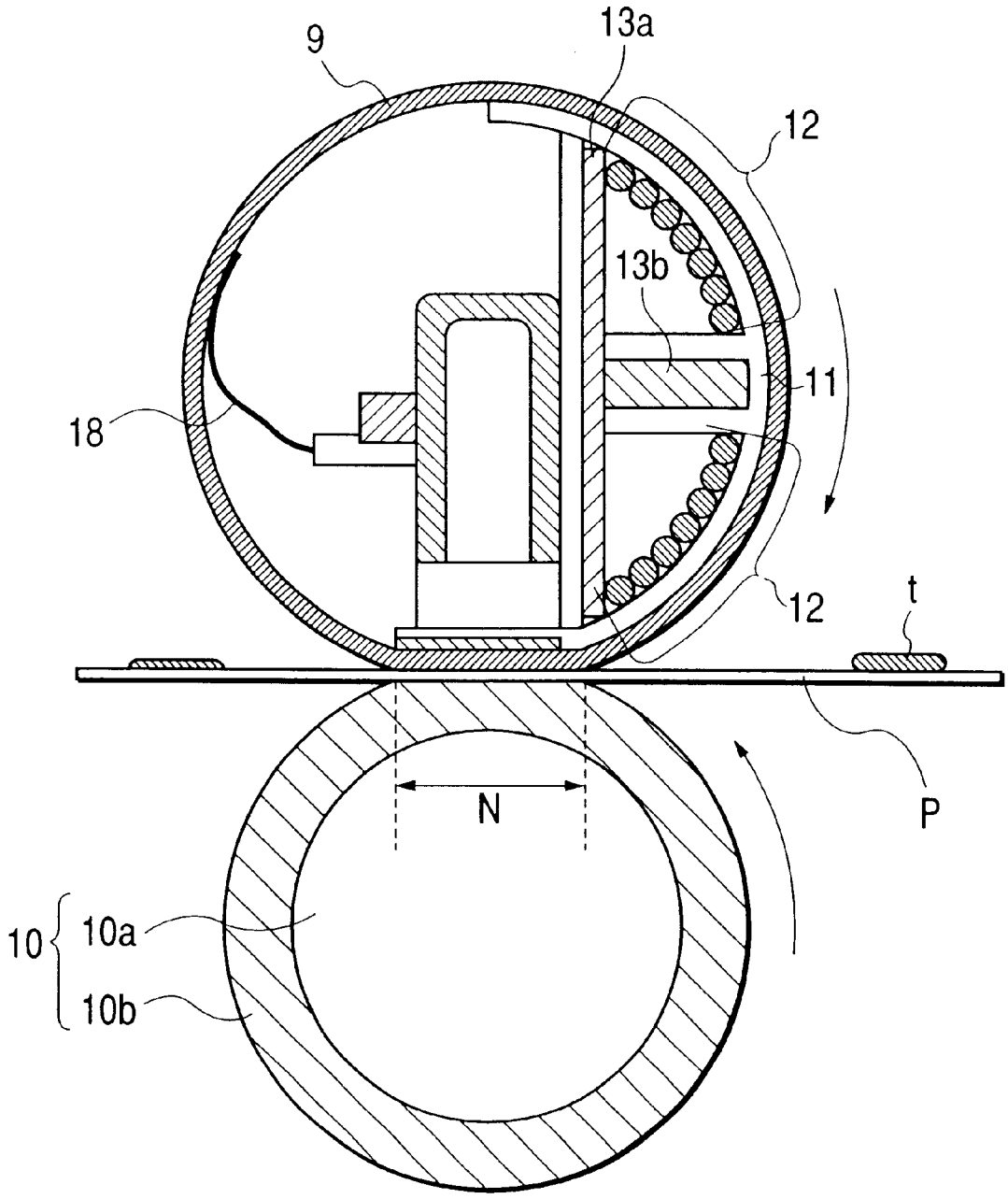
FIG. 16 is a drawing showing an image heating apparatus being a background art of the present invention.

The fixing apparatus 8 of this embodiment is a heating apparatus, which involves pressing roller drive system and electromagnetic inductive heating system and comprises a cylindrical electromagnetic heat-generating film (fixing film) 9 being a rotary member similar to the above described apparatus in FIG. 16, corresponds to an A3 size recording material at the largest.

The length $L_f$ in the longitudinal direction of the fixing film 9 (the direction perpendicular to the moving direction of the film) shown in FIG. 3 is 350 mm and the length $L_r$ of the pressing roller 10 in the longitudinal direction is 310 mm.

Magnetic cores 13*a* and 13*b* of the magnetic field generating means (magnetic flux generating means) are members with high permeability, and members used for cores of transformers such as ferrite and Permalloy, etc. are advisable, and more preferably ferrite which suffers from little loss even in not less than 100 kHz is advisable for use. In this embodiment, ferrite is used.

With an excitation coil 12, an excitation circuit 24 is connected in feeding sections 23*a* and 23*b* thereof as shown in FIG. 4. This excitation circuit 24 is arranged to be capable of generating high frequency waves of 20 kHz to 500 kHz with a switching power.

The excitation coil 12 generates an alternating magnetic flux with an alternating current (a high frequency current) supplied from the excitation circuit 24.

A film guide member 11 of a semi-circular arc gutter form is disposed horizontally as shown in the horizontal sectional view in FIG. 2, and the external side thereof is loosely fitted with the fixing film 9 being a cylindrical electromagnetic heat-generating film from outside.

As a material for the film guide member 11, those that are excellent in insulation in order to secure insulation against the fixing film 9 and have good heat resistance are advisable. It is advisable that for example, phenol resin, fluorine resin (PFA resin, PTFE resin, and FEP resin), polyimide resin, polyamide resin, polyamideimide resin, PEEK resin, PES resin, PPS resin, and LCP resin are selected.

The film guide member 11 holds the magnetic cores 13*a* and 13*b* and the excitation coil 12 being a magnetic field generating means inside thereof.

The reference numeral 14 denotes a horizontally long rigid stay for pressing which is disposed by being brought in contact with the internal plane section of the film guide member 11.

The reference numeral 15 denotes an adiabatic member preventing heat from being emitted the side of the stay 14 from the fixing nip section N.

The reference numeral 17 denotes a heat conducting member with larger heat conductance that the heat conductance of the fixing film 9, which is disposed on the upper surface of the opposite side of the fixing nip section N of the film guide member 11 and is brought into contact with the internal side of the fixing film 9. This heat conducting member will be described in detail later.

The reference numeral 19 denotes an insulating member, which are a member to implement insulation between the magnetic cores 13*a* and 13*b* as well as the excitation coil 12 and the rigid stay 14 for pressing.

The reference numerals 21*a* and 21*b* are flange members which are externally fitted onto both the left end section and the right end section of the assembly of the film guide member 11 so as to fix the above described left and right positions and be attached in a freely-rotary fashion and to regulate and hold the end portions of the fixing film 9.

The pressing roller 10 as a back up member is configured by a core 10*a* and a heat resistant and elastic material layer 10*b* such as silicone rubber, fluoro rubber, fluoro resin, etc. which is molded so as to cover to form a roller coaxially and integrally around the above described core, and is disposed so that the both end sections of the core 10*a* bearing-holds in a freely-rotary fashion between the (not shown) chassis side plates of the apparatus.

Pressing springs 22*a* and 22*b* are disposed in a compressed state respectively between the both end sections of the rigid stay for pressing 14 and the spring reception members 20*a* and 20*b* at the chassis side so that the downward force is applied onto the rigid stay 14 for pressing. Thus, the lower surface of the sliding member 16 disposed in the lower surface of the film guide member 11 and the upper surface of the pressing roller 10 sandwich the fixing film 9 and are brought into pressed contact to form a fixing nip section N of a predetermined width.

The pressing roller 10 is rotary-driven counterclockwise shown by the arrow. Frictional force generated by this rotary-driven pressing roller 10 and the external surface of the fixing film 9 causes applies a rotary force into the fixing film 9 and the above described fixing film 9 will be brought into a state in which the inner surface thereof rotates around the external circumference of the film guide member 11 with a peripheral velocity approximately corresponding to the rotary peripheral velocity of the pressing roller 10 clockwise shown by the arrow while sliding in tight contact with the lower surface of the sliding member 16 in the fixing nip section N.

In this case, in order to reduce the mutual sliding frictional force between the lower surface of the sliding member 16 in the fixing nip section N and the inner surface of the fixing film 9, a lubricant such as heat resistant grease can be applied between the lower surface of the sliding member 16 of the fixing nip section N and the inner surface of the fixing film 9 or the lower surface of the sliding member 16 can be coated by a lubricant member.

Figure 5:
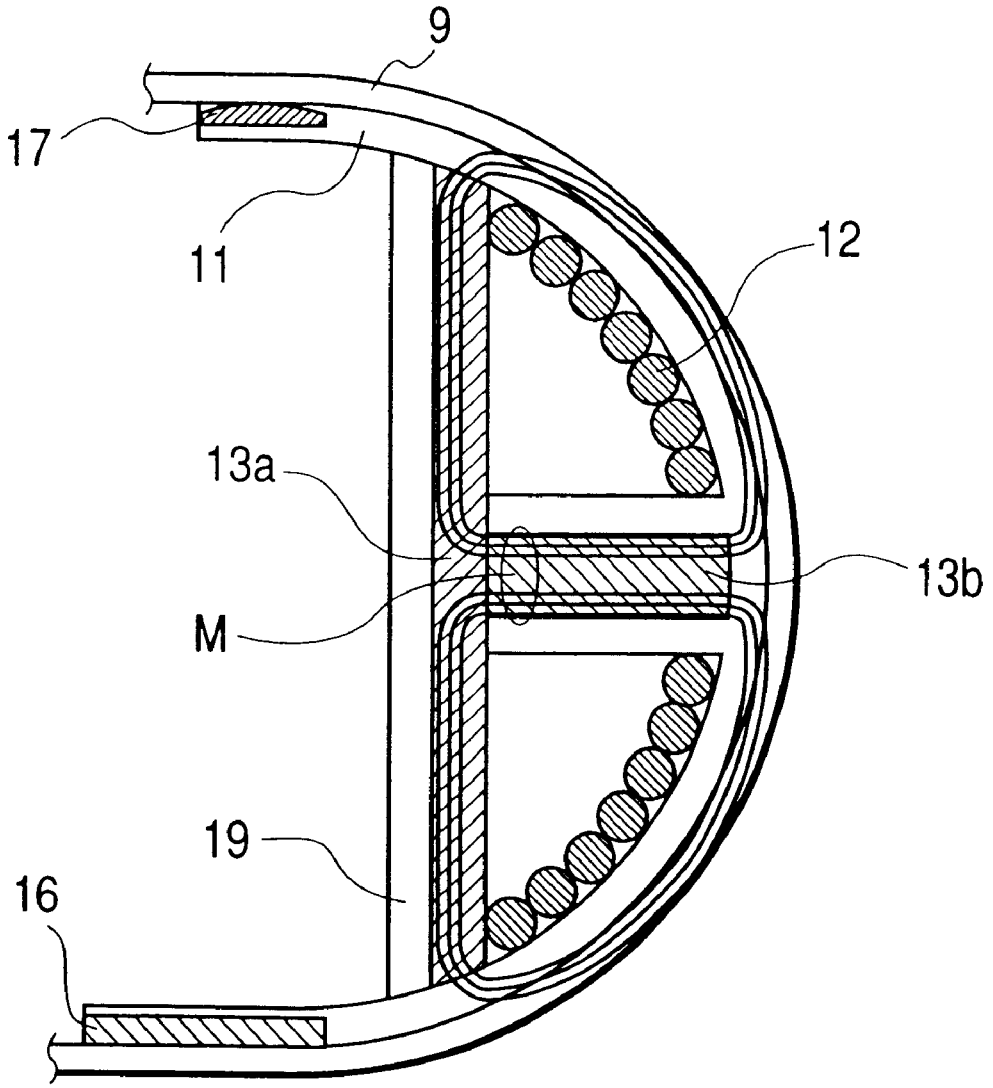
FIG. 5 is drawing showing the stream of the magnetic flux.

FIG. 5 shows by modeling how the alternating magnetic flux from the excitation coil 12 and the magnetic cores 13*a* and 13*b* being magnetic field generating means. The magnetic flux M shows a portion of the generated alternating magnetic flux. The alternating magnetic flux M led by the magnetic cores 13*a* and 13*b* generates an eddy current in the electromagnetic inducting heat generating layer 9*a* (in FIGS. 8A and 8B) of the fixing film 9. This eddy current generates Joule heat (eddy current loss) in the electromagnetic inducting heat generating layer 9*a* with the proper resistant of the electromagnetic inducting heat generating layer 9*a*.

For the excitation coil 12, copper-made thin lines which respectively have undergone insulation-coating one by one are bundled (a bundled line) are used as a conducting wire (a wire) configuring a coil (line loops) and this is scrolled a plurality of times to form an excitation coil. In this embodiment, the coil is scrolled seven times to form the excitation coil 12.

As for the insulation coating, considering heat conductance due to generation of the fixing film 9, it is advisable to use a heat resistant coating. In this embodiment, coating by way of polyimide is adopted with the heat resistant temperature of 220° C.

Here, density may be improved by applying pressure from the external section of the excitation coil 12.

The excitation coil 12 is shaped to go along the curved surface of the electromagnetic inducting heat generating layer 9*a* of the cylindrical fixing film 9 as shown in FIG. 2 and FIG. 5.

Figure 8A:
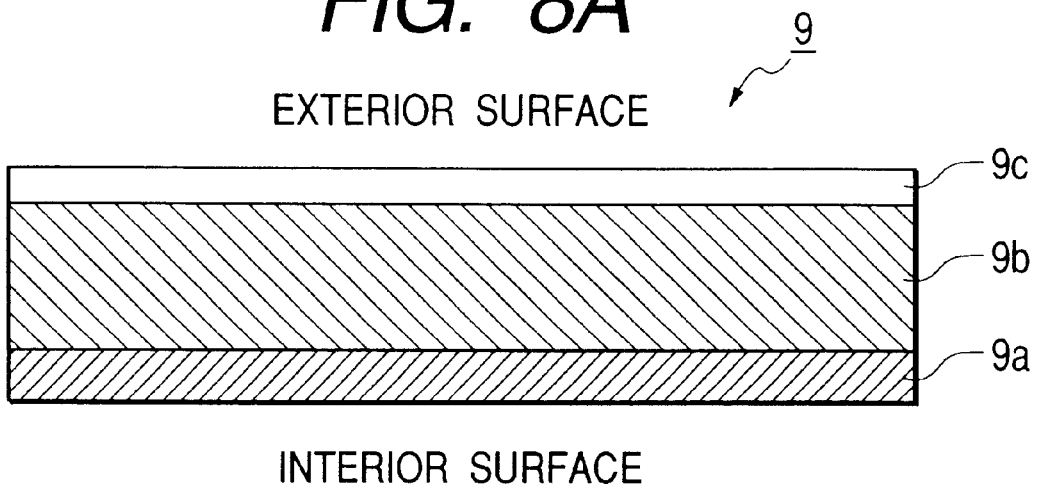
FIGS. 8A and 8B are drawings showing layer configuration of the rotary members.
Figure 8B:
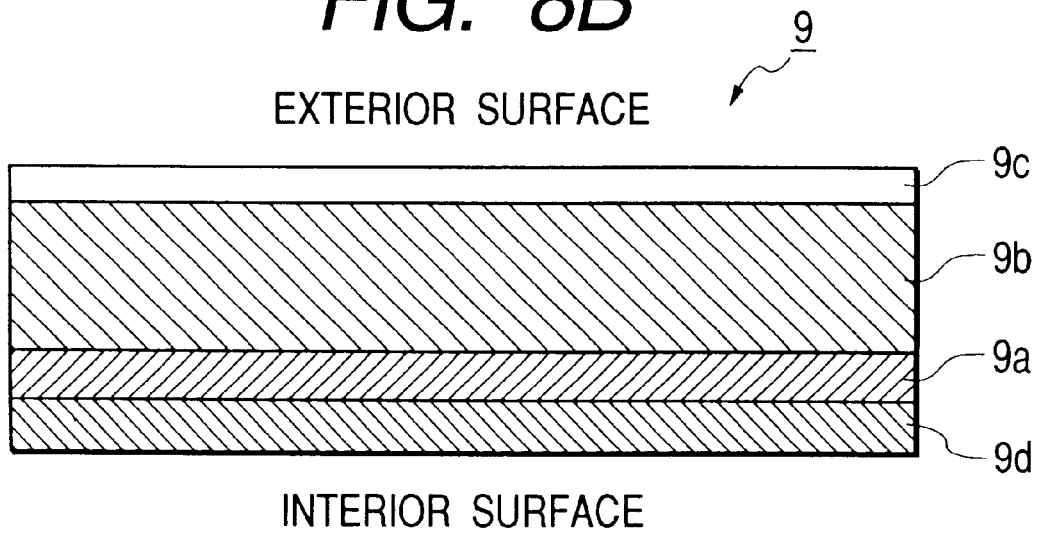

FIGS. 8A and 8B are sectional model views respectively showing layer configurations of the fixing film 9.

FIG. 8A is a sectional model view of the fixing film 9 in this embodiment. This fixing film 9 is a one having a compound configuration by comprising an electromagnetic inducting heat generating layer 9*a* made of a metal film, etc. to become a base layer of the electromagnetic inducting heat generating fixing film, an elastic layer 9*b* laminated on the external surface thereof, and a separated shaped layer 9*c* further laminated on the external surface thereof.

In order to glue the heat generating layer 9*a* with the elastic layer 9*b*, and to glue the elastic layer 9*b* with the separated shaped layer 9*c*, a (not shown) primer layer may be provided between respective layers.

In the above described layer configuration, the heat generating layer 9*a* is the interior surface side of the cylindrical fixing film 9 while the releasing layer 9*c* is the exterior surface side thereof.

As described above, an alternating magnetic flux is applied to the heat generating layer 9*a* to generate an eddy current in the above described heat generating layer 9*a* to cause the above described heat generating layer 9*a* to generate heat. That heat heats the recording material P which undergoes sheet passing at the above described fixing nip section N via the elastic layer 9*b* and the releasing layer 9*c* so that the toner image undergoes heat-fixing.

The heat generating layer 9*a*, the elastic layer 9*b*, and the releasing layer 9*c* configuring the fixing film 9 will be described based on FIGS. 8A and 8B as follows:

a. Heat generating layer 9*a*

The heat generating layer 9*a* may be made of non-magnetic metal but it is advisable to use a metal of ferromagnetic substance such as nickel, ferromagnetic SUS, and nickel-cobalt alloy.

Thickness thereof is preferably thicker than the depth of the surface skin expressed by the following equation and is not more than 200 μm. The depth of the surface skin σ[m] is expressed with the frequency f [Hz] and the permeability μ and the proper resistant ρ [Ωm] of the excitation circuit 24 as follows:

$$\sigma=503\times(\rho/f\mu)^{1/2}$$

This expresses the depth of absorption of the electromagnetic wave to be used for the electromagnetic inductance, and at the place deeper than this, the intensity of the electromagnetic wave will be not more than 1/e, and in the opposite expression, almost all energy is absorbed without reaching this depth.

It is advisable that the thickness of the heat generating layer 9*a* is preferably 1 to 100 μm. With the thickness of the heat generating layer 9*a* is smaller than 1 μm, almost all electromagnetic energy is not completely absorbed and efficiency will get worse. In addition, the heat generating layer 9*a*, which has thickness exceeding 100 μm, will become too much rigid and its bending performance will gets worse and it is not realistic to use it as a rotary body. Accordingly, thickness of the heat generating layer 9*a* is preferably 1 to 100 μm.

In this embodiment, the heat generating layer 9*a* is made of nickel having thickness of 50 μm.

b. Elastic layer 9*b*

The elastic layer 9*b* is made of a material with good heat resistance and good thermal conductivity such as silicon rubber, fluoro rubber, and fluoro-silicon rubber, etc.

Thickness of the elastic layer 9*b* is preferably 10 to 500 μm. This thickness of elastic layer 9*b* is preferable in order to guarantee the fixing image quality.

In the case where an color image is printed, in particular in the case of a photo image, a solid image is formed over a large area on the recording material P. In this case, when the heating surface (the releasing layer 9*c*) can not follow unevenness of the recording material or unevenness of the toner layer, inconsistent heating takes place and gives rise to uneven gloss on the image between in the portion having large heat conductance and in the portion having that less. The gloss level is high in the portion with large heat conductance and the gloss level is low in the portion with less heat conductance. With the thickness of the elastic layer 9*b* of not more than 10 μm, unevenness of the recording material or the toner layer cannot be completely followed and will give rise to uneven image gloss. In addition, in the case of the elastic layer 9*b* of not less than 1000 μm, thermal resistance of the elastic layer will become large and it will become difficult to realize a quick start. It is further preferably advisable that the thickness of the elastic layer 9*b* is 50 to 500 μm.

With too much high hardness of the elastic layer 9*b*, unevenness of the recording material or of the toner layer cannot be completely followed and will give rise to uneven image gloss. Under the circumstances, as hardness of the elastic layer 9*b*, not more than 60° (JIS-A; JIS-K A type test machine) and further preferably not more than 45° is advisable.

As concerns the thermal conductivity λ of the elastic layer 9*b*, $6\times10^{-4}$ to $2\times10^{-3}$ [cal/cm·sec·deg.] ($2.51\times10^{-1}$ to $8.37\times10^{-1}$ [W/m·deg]) is advisable.

In the case where the thermal conductivity λ is smaller than $6\times10^{-4}$ to $2\times10^{-3}$ [cal/cm·sec·deg.], the thermal resistant becomes large, and the temperature increase in the surface layer of the fixing film 9 (the releasing layer 9*c*) will become slow.

In the case where the thermal conductivity λ is larger than $2\times10^{-3}$ [cal/cm·sec·deg.], the hardness will become too much high and the compression permanent strain could get worse.

Therefore, it is advisable that the thermal conductivity λ is $6\times10^{-4}$ to $2\times10^{-3}$ [cal/cm·sec·deg.]. Further preferably, $8\times10^{-4}$ to $1.5\times10^{-3}$ [cal/cm·sec·deg.] ($3.35\times10^{-1}$ to $6.28\times10^{-1}$ [W/m·deg]) is advisable.

As described so far, in this embodiment, the elastic layer 9*b* is made of silicon rubber with thickness of 300 μm.

c. Releasing layer 9*c*

For the releasing layer 9*c,* materials with good shape-separate characteristics and good thermal resistance such as fluorine resin (PFA, PTFE, and FEP), silicon resin, and fluoro-silicone rubber, fluoro rubber, silicone rubber etc. can be selected.

Thickness of the releasing layer 9*c* is preferably 1 to 100 μm. Thickness of the releasing layer 9*c* smaller than 1 μm gives rise to such problems that portions with poor shape-separate characteristic due to uneven painting on the paint film or durability becomes insufficient. In addition, thickness of the separate shaped layer exceeding 100 μm gives rise to such problems that thermal conductivity gets worse, and in particular, in the case of the separate shaped layer in resin system, hardness gets too much high and the elastic layer 9*b* will get no longer efficient.

In this embodiment, the releasing layer 9*c* is made of PFA resin of 5 μm thickness.

In addition, as shown in FIG. 8B, in the layer configuration of the fixing film 9, on the free surface side of the heat generating layer 9*a* (the opposite surface side against the elastic layer 9*b* side of the heat generating layer 9*a*) may be provided the insulating layer 9*d* in spite that it is not provided in particular for this embodiment.

As the insulating layer 9*d,* heat resistant resin such as fluorine resin (PFA resin, PTFE resin, and FEP resin), polyimide resin, polyamide resin, polyamideimide resin, PEEK resin, PES resin, and PPS resin is advisable.

In addition, as for thickness of the insulating layer 9*d,* 10 to 1000 μm is preferable. In the case where thickness of the insulating layer 9*d* is smaller than 10 μm, insulating effects becomes unavailable, and durability becomes insufficient. On the other hand, in excess of 1000 μm, distance of the heat generating layer 9*a* from the magnetic cores 13*a* as well as 13*b* and the excitation coil 12 gets large so that the magnetic flux will not sufficiently absorbed by the heat generating layer 9*a*.

The insulating layer 9*d* can undergo insulation so that the heat generated in the heat generating layer 9*a* is not directed to the interior side of the fixing film and therefore compared with the case with not insulating layer 9*d,* the heat supply efficiency toward the side of the recording material P will get better. Thus, consumption power can be suppressed.

Eddy current which is generated in the electromagnetic inducting heat generating layer 9*a* of the fixing film 9 with the alternating magnetic flux generated by the above described alternate current supplied to the excitation coil 12 serves to cause the heat generating region H (in FIG. 3) of the fixing film 9 to generate heat.

Heat generation of the fixing film 9 undergoes heat control so that a not-shown temperature controlling system including temperature detection means 18 (in FIG. 2) control current supply to the excitation coil 12 and thereby the temperature of the fixing nip section N is maintained at a predetermined level. Temperature detection means 18 is a temperature sensor such as a thermistor to detect temperature of the fixing film 9, and in this embodiment, the temperature sensor 18 is arranged to be disposed on the downstream side in the direction of the film rotation of the fixing nip section N on the interior surface of the fixing film 9 and the temperature of the fixing nip section N is arranged to be controlled based on the temperature of the temperature sensor 18.

Fixing operation, in which the pressing roller 10 is rotary-driven, and accompanied thereby the cylindrical fixing film 9 rotates around the exterior of the film guide member 11 and the fixing film 9 undergoes electromagnetic inducting heat generation by power supply to the excitation coil 12, is implemented under the state that the fixing nip section N undergoes temperature control at 180° C. being a predetermined temperature at the starting point.

Under the above described state, the recording material P in which unfixed toner image t is formed is introduced between the fixing film 9 of the fixing nip section N and the pressing roller 10 with the image surface being directed upward, that is, being allowed to face the fixing film surface, and is conveyed under the state that the image surface has been brought into tight contact to the exterior surface of the fixing film 9, and in the course of this procedure, heat generation by the electromagnetic induction of the fixing film 9 heats the unfixed toner image t undergoes heat fixing onto the recording material P. The recording material P pass through the fixing nip N to get departed from the exterior surface of the rotary fixing film 9 and to be conveyed for discharging. After the heating fixing toner image on the recording material has passed through the fixing nip section, it is cooled to become a permanent fixed image.

Since in this embodiment the toner that is arranged to contain low softened substance is used for the toner t, no oil applying mechanism is provided to the fixing apparatus in order for offset prevention, but in the case where a toner that is arranged to contain no low softened substance is used, an oil applying mechanism may be provided. In addition, also in the case where a toner that is arranged to contain low softened substance is used, oil coating and cooling separation may be implemented.

The heat conducting member 17 will be described in detail as follows.

At the time of the above described fixing operation, temperature distribution in the longitudinal direction of the fixing film 9 is not maintained evenly at the time when the unfixed image t on the recording material P is conveyed to the fixing nip section N, resulting in poor image such as uneven gloss, etc., and causing poor fixation in the portion where the temperature of the fixing film 9 is low.

In addition, in particular, in the case of an OHP film being the recording material, unevenness in transparency of image will appear remarkably.

In addition, in the case where the recording materials, in particular, an envelope and recording materials such as A4 vertical size sheet and LETTER vertical size sheet passing, undergo sheet feeding continuously, temperature of the non-sheet passing section of the fixing film 9 will excessively increase, and thus the toner on the recording material P undergo offsetting on the fixing film 9 to make good fixing image unobtainable.

Moreover, excess increase in the temperature of the non-sheet passing section of the fixing film 9 gives rise to a large temperature grade locally in the temperature distribution, giving rise to such problems that the fixing film 9 is damaged or the film guide member 11 undergo deformation.

Therefore, in this embodiment, in order to solve the above described problems, for the purpose of making temperature distribution of the fixing film 9 at the time of fixing operation even, as shown in FIG. 2 and FIG. 4, the heat conducting member 17 which has heat conductance larger than heat conductance of the fixing film 9 is disposed on the upper surface of the opposite side of the fixing nip section N of the film guide member 11 so that the heat conducting member 17 is brought into contact with the interior side of the fixing film 9.

When the heat conducting member 17 is disposed inside the fixing nip section N, the thermal capacity of the fixing nip section N increases and the thermal response of the fixing nip section N toward the heat control based on temperature of the temperature sensor 18 gets worse resulting in poor fixing.

The length in the longitudinal direction of the heat conducting member 17 should be not less than the length in the longitudinal direction of the fixing film heat generating region H as shown in FIG. 3 and otherwise cannot make the temperature distribution in the longitudinal direction of the fixing film effectively even.

That is, as shown in FIG. 4, as concerns the direction perpendicular to the movement direction of the film 9, the length L of the heat conduction member 17 is not less than the length $L_h$ of the interior side region of the coil 12 enclosed by the coil 12, and as concerns the longitudinal direction, the heat conducting member 17 covers the whole interior side region of the coil 12.

In addition, the length L of the heat conducing member 17 is not more than the length $L_f$ in the longitudinal direction of the film 9, and as concerns in the longitudinal direction, the heat conducting member 17 exists within the range of the film 9.

That is, $L_h \leqq L \leqq L_f$.

The length in the longitudinal direction of the above described heat generating region H in this embodiment is 300 mm, and the length of the heat conducting member 17 is set at 330 mm. The length of the film 9 is 350 mm as described above.

In this embodiment, aluminum nitride being a ceramic having heat conductivity k of k=167 [W/m·K] is used for the heat conducting member 17.

Aluminum nitride has good surface sliding performance compared with the case of metals such as iron, even if the heat conducting member 17 is not coated with lubrication member, sufficient sliding performance can be obtained. Thereby, with durability of the fixing film 9 being secured, configuration of the heat conducting member can be planned to undergo simplification.

Aluminum nitride is non-magnetic and insulating member, and therefore is not affected by the magnetic field given rise to by the magnetic field generating means.

The above described heat conducting member 17 has thickness of 2 [mm] at the thickest portion, and as in FIG. 2, the surface having curvature in order to secure sliding performance is brought into contact in such a fashion that it is pressing-attached onto the interior surface of the fixing film 9. The heat conducting member is substantially in a plate form.

Here, the thermal capacitance of the fixing film 9 in this embodiment is around 20 [$J \cdot K^{-1}$], and when the thermal capacity of the heat conducting member is too small, temperature of the heat conducting member itself will increase at once to give up performing its function, and thus the heat conducting member 17 of this embodiment has a shape so as to have the thermal capacitance not less than this.

In addition, such a consideration is paid to the heat conducting member 17 that it does not generate heat with the excitation coil 12 and the magnetic cores 13*a* and 13*b* being magnetic filed generating means. That is, in order not to be affected by the magnetic field to be generated, it is disposed outside the magnetic field to be formed by the magnetic flux M shown in FIG. 5.

Figure 6:
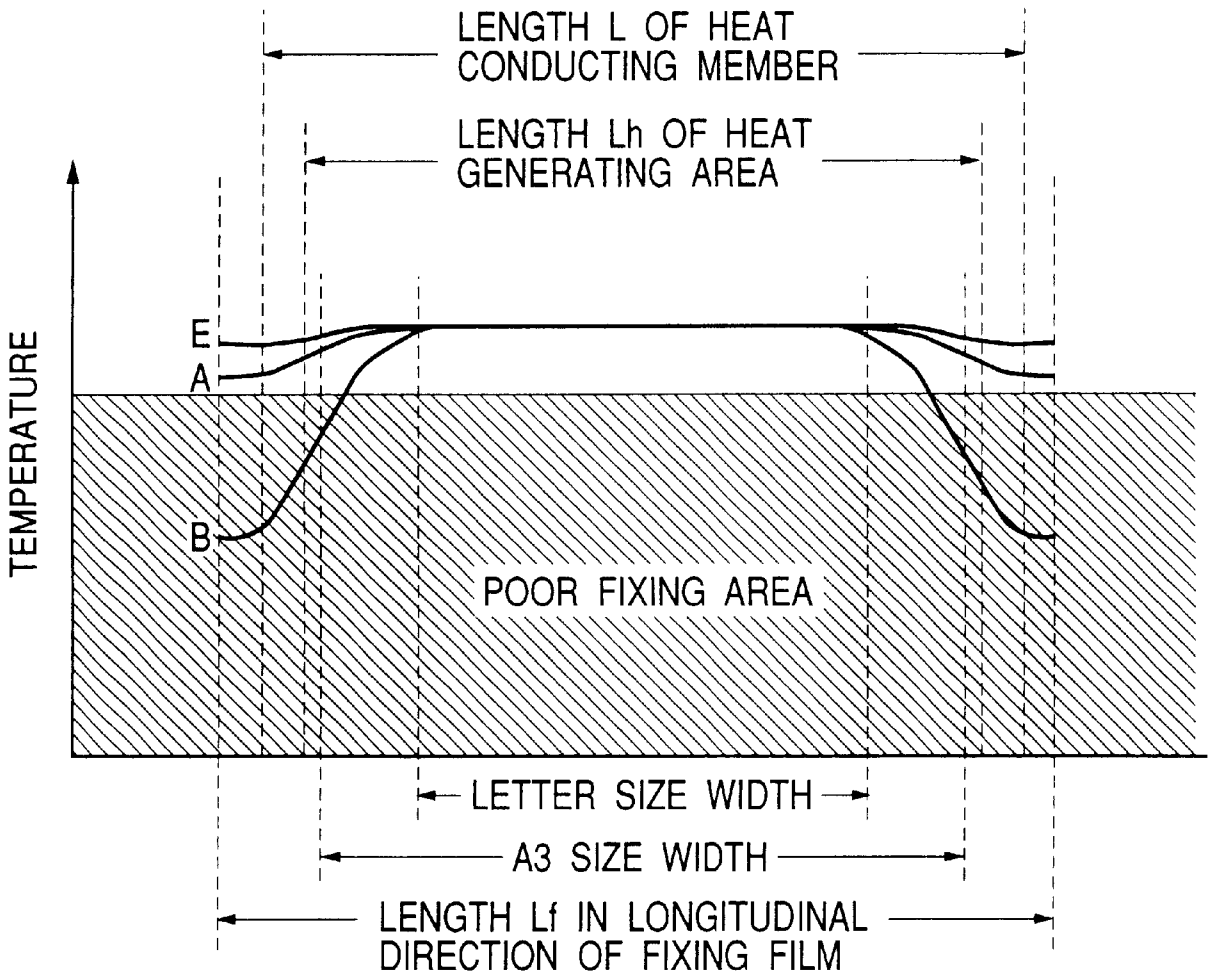
FIG. 6 is drawing showing the temperature distribution of the rotary member.

FIG. 6 shows the fixing film temperature distribution B in the case where the heat conducting member 17 is not provided and the fixing film temperature distribution A in the case where the heat conducting member 17 of aluminum nitride as in this embodiment is provided.

In the case where the heat conducting member 17 is not provided, in accordance with environment, temperature drop at the end section of the fixing film is large, and when an unfixed toner image on an A3 size recording material undergoes fixing under this state, there is a case where poor fixing could be caused to take place at the end section of the image.

In addition, in the case where the recording material is an A4 size OHP film, and this is conveyed into the fixing apparatus in the horizontal direction and undergoes fixing, there is a case where transparency at the time of projection gets worse at the tip section and the rear end section in the longitudinal direction of the A4 size.

On the other hand, in the case where the heat conducting member 17 of aluminum nitride is disposed as in FIG. 2 and FIG. 4, in spite that heat conductance in the longitudinal direction of the fixing film 9 itself could be insufficient, heat conducting can take place in the longitudinal direction of the fixing film with the heat conducting member 17, and therefore the temperature grade in the longitudinal direction in the fixing film 9 can be eased and the temperature at the end section of the fixing film can be held higher than in the poor fixing region so that such problems as described above can be avoided.

In addition to the problems on the above described poor fixing, in the case where small size sheet with relatively narrower than the length $L_h$ in the longitudinal direction of the heat generating region H (in FIG. 3) in the fixing film 9 undergoes sheet passing, in particular, when the sheet undergoes sheet feeding continuously, there is a problem on temperature rise in the non-sheet passing portion of the fixing film 9.

Figure 7:
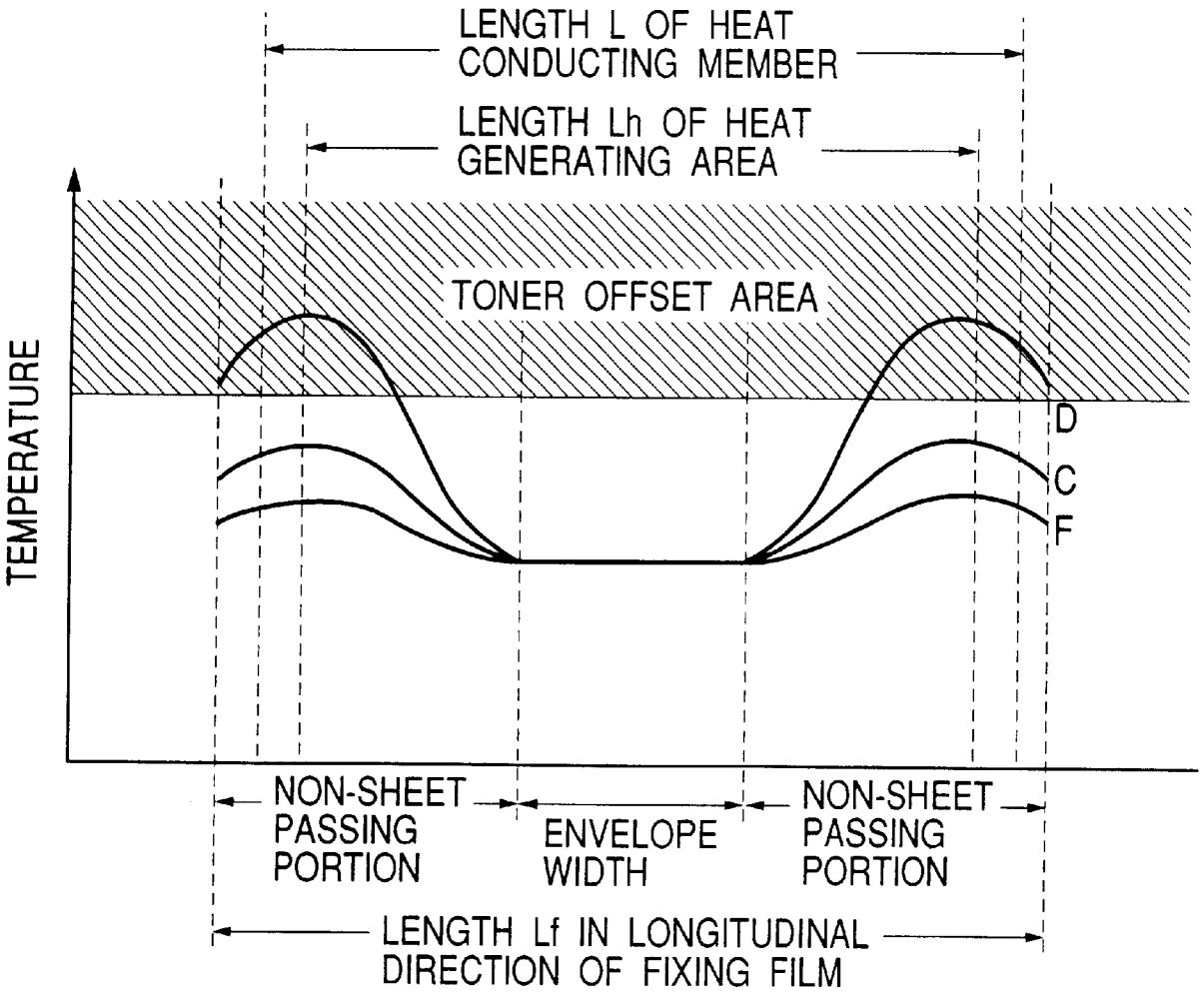
FIG. 7 is drawing showing the temperature rise in the non-sheet passing portion of the rotary member.

FIG. 7 shows temperature distribution in the longitudinal direction of the fixing film 9 in the case where envelopes undergo sheet passing continuously into the fixing apparatus in which no heat conducting member 17 is provided and into the fixing apparatus of this embodiment in which the heat conducting member 17 of aluminum nitride is disposed.

In the case where no heat conducting member 17 is provided, temperature distribution of the fixing film 9 will be like D in FIG. 7, and the temperature in the non-sheet passing portion rises to enter the toner offset region so that, in the case a recording material with width larger than an envelope such as an A3 size sheet or a LETTER size sheet undergoes fixing immediately after continuous sheet passing of envelopes, the toner in the portion covering the non-sheet passing portion at the time when an envelope undergoes sheet passing will undergo offsetting onto the fixing film.

In addition, with the temperature excessively rising in the non-sheet passing portion of the fixing film, film guide member could undergo deformation, and the fixing film itself could be damaged.

On the other hand, in the case of the fixing apparatus of this embodiment in which a heat conducting member 17 of aluminum nitride is disposed as in FIG. 2 and FIG. 4, even if the temperature of the non-sheet passing portion of the fixing film 9 start rising due to continuous sheet passing of envelopes, the heat due to temperature rise of the non-sheet passing portion is caused to conducted to the sheet-passing region by the heat conducting member 17 so that as in C in FIG. 7, the temperature at the non-sheet passing portion can be prevented from reaching the toner offset region.

Accordingly, immediately after continuous sheet passing of envelopes, a large-size sheet such as A3 size sheets and LETTER size sheets, etc., undergoes sheet passing, no toner offset takes place, and simultaneously, it is possible to prevent damages onto the fixing apparatus due to unreasonable temperature increase.

Thus, since temperature increase of the non-sheet passing portion can be reduced, compared with conventional one, improvement in throughput can be realized.

Moreover, since the temperature in the non-sheet passing portion can be made low, as in the present configuration, in the case where an elastic layer 9*b* such as a silicon rubber is provided in the fixing film 9, deterioration of rubber can be suppressed so that durability is increased.

As described so far, in this embodiment, as in FIG. 2 and FIG. 4, the heat conducting member 17 of the aluminum nitride is disposed over the heating region of the film 9 subject to $L \leqq L_h$ so that poor fixing at the end section of a large-size sheet and toner offset onto the fixing film at the time when a large-size sheet undergoes sheet passing immediately after a small-size sheet such as an envelope, etc. undergoes sheet passing can be avoided, and thereby throughput can be improved than in the conventional one.

In addition, when the length of the heat conducting member is larger than the length of the film, that is, the heat conducting member is protruded from the end section of the film to be exposed outward, that protrusion operates as a heat discharging section, resulting in temperature decrease in the entire heat conducting member, giving rise to a problem that the temperature of the film becomes hardly increasable. In addition, when the protrusion is cooled rapidly, the film end section in the vicinity of the protrusion undergoes temperature decrease compared with the central section of the film, giving rise to a problem that for example, at the time when a recording material of A3 size undergoes sheet passing, poor fixing takes place at end sections of the recording material.

However, in this embodiment, since the heat conducting member is within the range of the film subject to $L \leqq L_f$, the entire film will not cooled unreasonably with the heat conducting member, thus thermal efficiency can be improved and poor fixing at end sections of the recording material due to cooling at the end section of the film can be prevented.

With aluminum nitride used as the heat conducting member 17 in this embodiment, compared with another metal, such as iron (k=72 [W/m·K] and nickel (k=83 [W/m·K]), the heat conductivity is high, giving rise to temperature decreasing effects at the non-sheet passing section that is larger than that in the case where these materials are used.

In this embodiment, as the heat conducting member 17, aluminum nitride is used, but any good non-magnetic conducting member will do as a heat conducting member, and materials with thermal conductivity k subject to $k \geqq 100$ [W/m·K], or for example ceramics such as beryllia, and silicon carbide, etc. are preferably used. In particular, it is preferable to use materials of $k \geqq 70$ [W/m·K].

Figure 9:
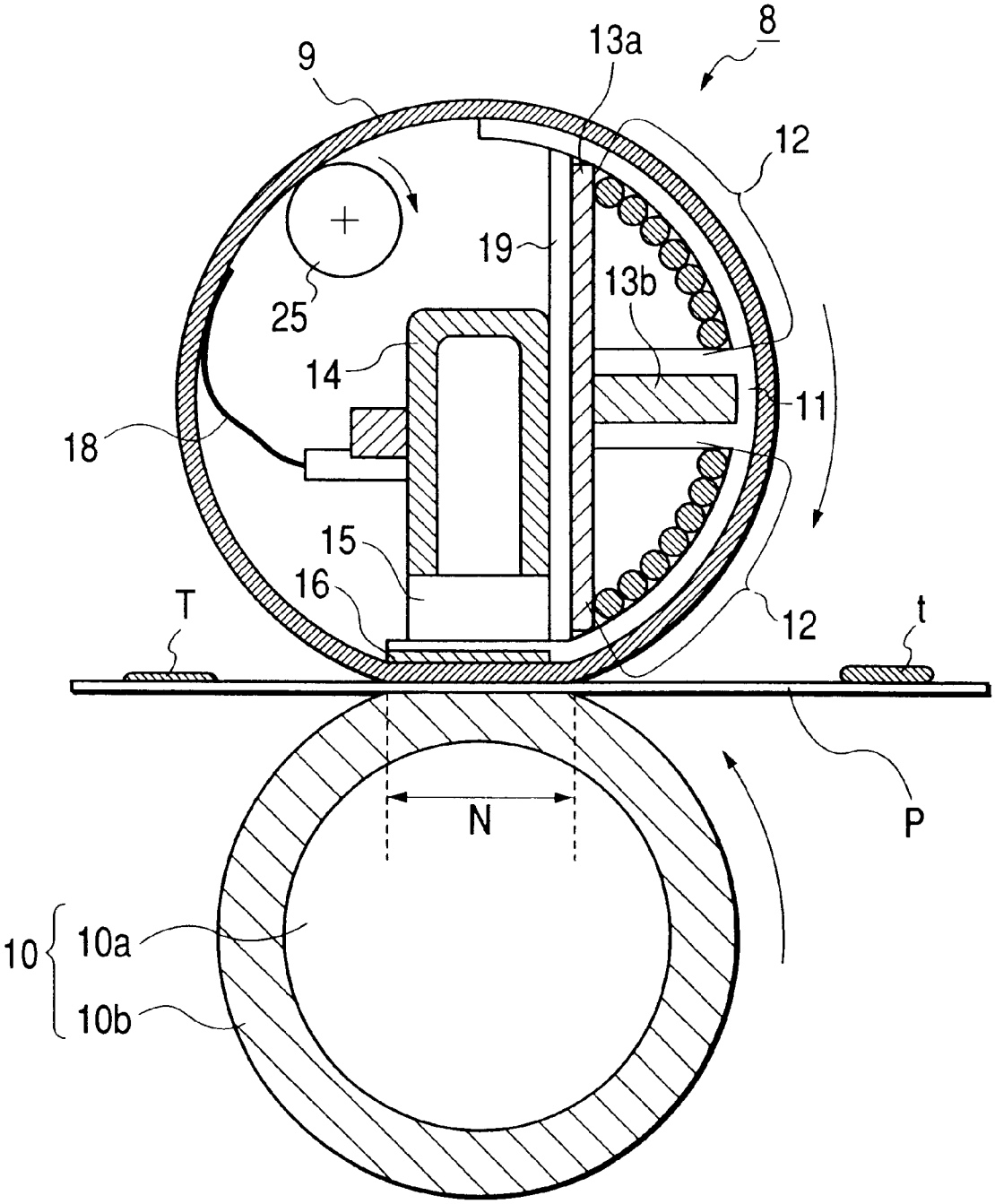
FIG. 9 is a drawing showing an image heating apparatus being another embodiment.
Figure 10:
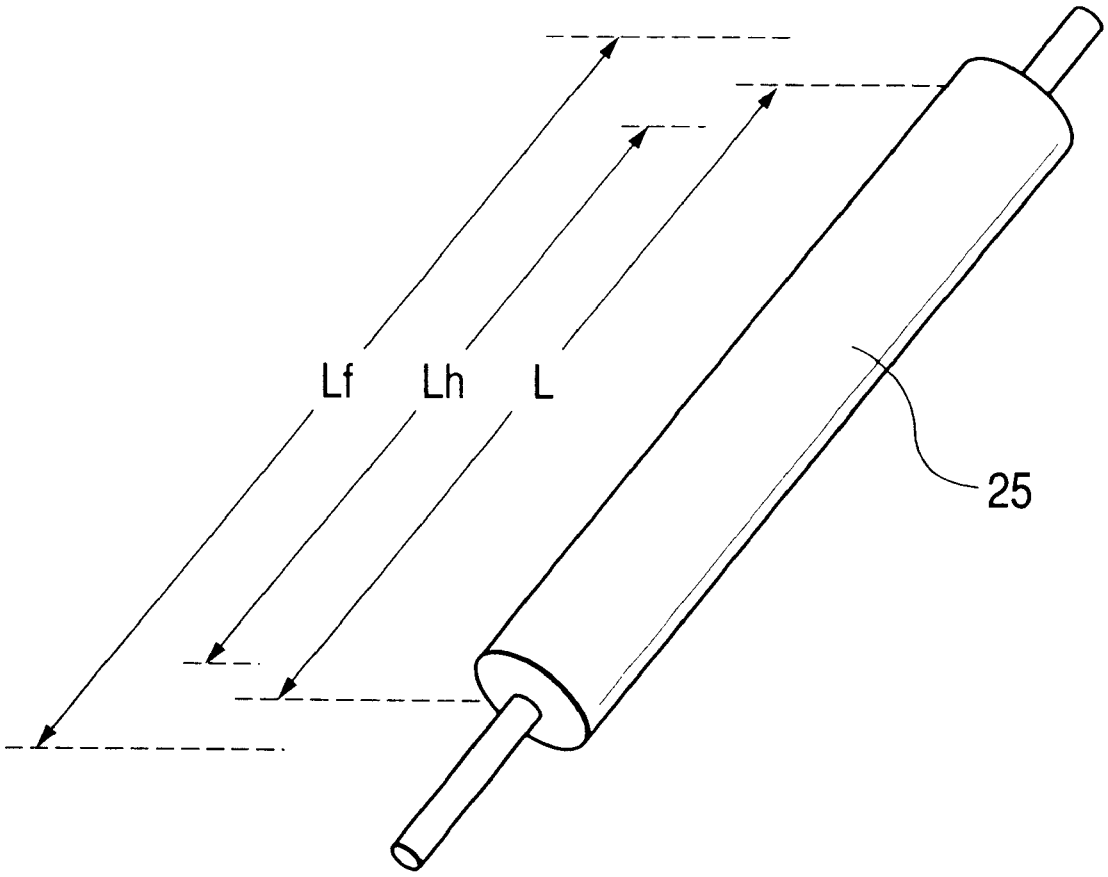
FIG. 10 is a drawing showing a heat conducting member.

<Embodiment 2> (FIG. 9 and FIG. 10)

In this embodiment, as for the heat conducting member, in place of the heat conducting member 17 in Embodiment 1, as shown in FIG. 9, a non-magnetic aluminum roller 25 with thermal conductivity k=240 [W/m·K] is employed and the above described roller 25 is brought into contact from the interior surface of the fixing film 9.

In this embodiment, configuring members and portions that are common with those in the apparatus of Embodiment 1 are placed with the same symbols so that repetitious description is omitted.

As shown in FIG. 10, the roller 25 as a good heat conducting member has a form so that the portion with length of L in the longitudinal direction is brought into contact with the fixing film 9. This roller 25 has a portion of 8 mm diameter to be brought into contact with the fixing film 9. As in Embodiment 1, $L_h \leqq L \leqq L_f$.

As described above, thermal capacity of the fixing film 9 is around 20 [J/K], but thermal capacity of the roller 25 as a heat conducting member is larger by several times than that, and therefore there will be no need to be concerned about that temperature of the roller 25 itself immediately rises so as not to perform its function any more.

The roller 25 is disposed so as to rotate in the arrowed direction following rotation of the fixing film 9, and compared with a fixed member such as the heat conducting member 17 of Embodiment 1, such a force to prevent rotation of the fixing film 9 can be reduced. The outer periphery of the roller 25 may be coated with a lubrication member.

In this embodiment, the roller 25 of aluminum used as the thermal conducting member can undergo heat conduction more than the heat conducting member 17 in Embodiment 1 since the heat conductivity k of aluminum is approximately 1.4 times larger compared with aluminum nitride (k=167 [W/m·K]) of the heat conducting member 17 used in Embodiment 1.

As shown in FIG. 6, even compared with temperature distribution A of the fixing film in the case where the heat conducting member 17 of Embodiment 1 is provided, temperature distribution E of the fixing film of this embodiment undergo further reduction in temperature decrease in end sections so that temperature distribution in the sheet passing region gets closer to a flat state.

In addition, as shown in FIG. 7, as concerns temperature increase of the fixing film at the non-sheet passing portion at the time when a small-size sheet undergoes sheet passing as well, compared with the temperature distribution C in the case where the heat conducting member 17 of Embodiment 1 is provided, temperature rise at the non-sheet passing portion is reduced in the temperature distribution F in the case where the aluminum roller 25 of this embodiment is disposed.

As described above, as a heat conducting member, by disposing the aluminum roller 25 as in FIG. 9, without increasing any force necessary to cause the fixing film 9 to rotate, the temperature drop in the end sections of the fixing film can be further reduced to prevent poor fixing and simultaneously the temperature rise at the non-sheet passing section when a small-size sheet undergoes sheet passing can be further reduced and thus there is no need to concern about toner offset at the time when a large-size sheet undergoes sheet passing immediately after a small-size sheet undergoes sheet passing, and throughput on small-size sheets can be increased than in Embodiment 1. In addition, since this embodiment fulfills $L \leqq L_f$, a similar effect as in Embodiment 1 can be obtained.

Figure 11:
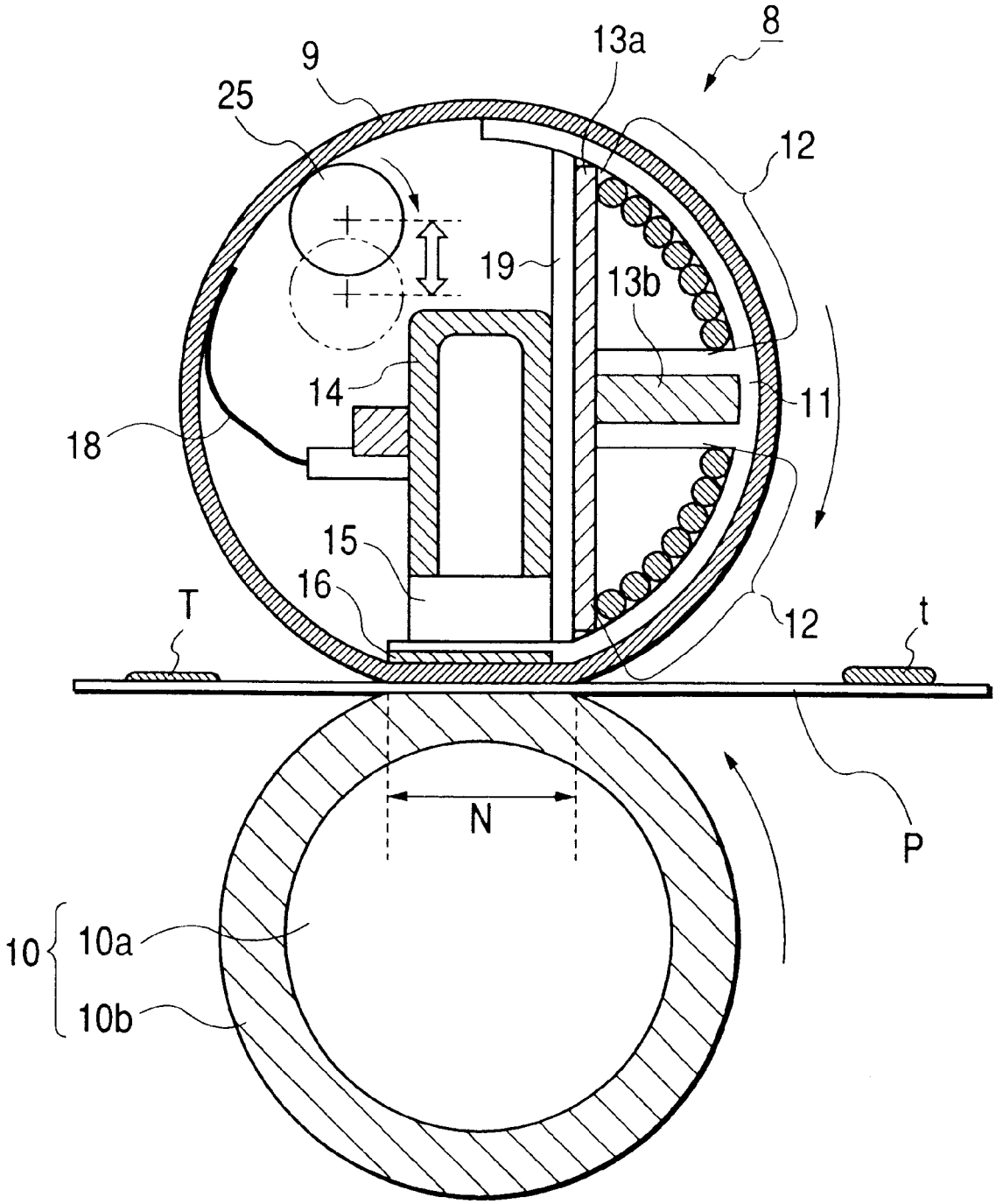
FIG. 11 is a drawing showing an image heating apparatus being another embodiment.
Figure 12:
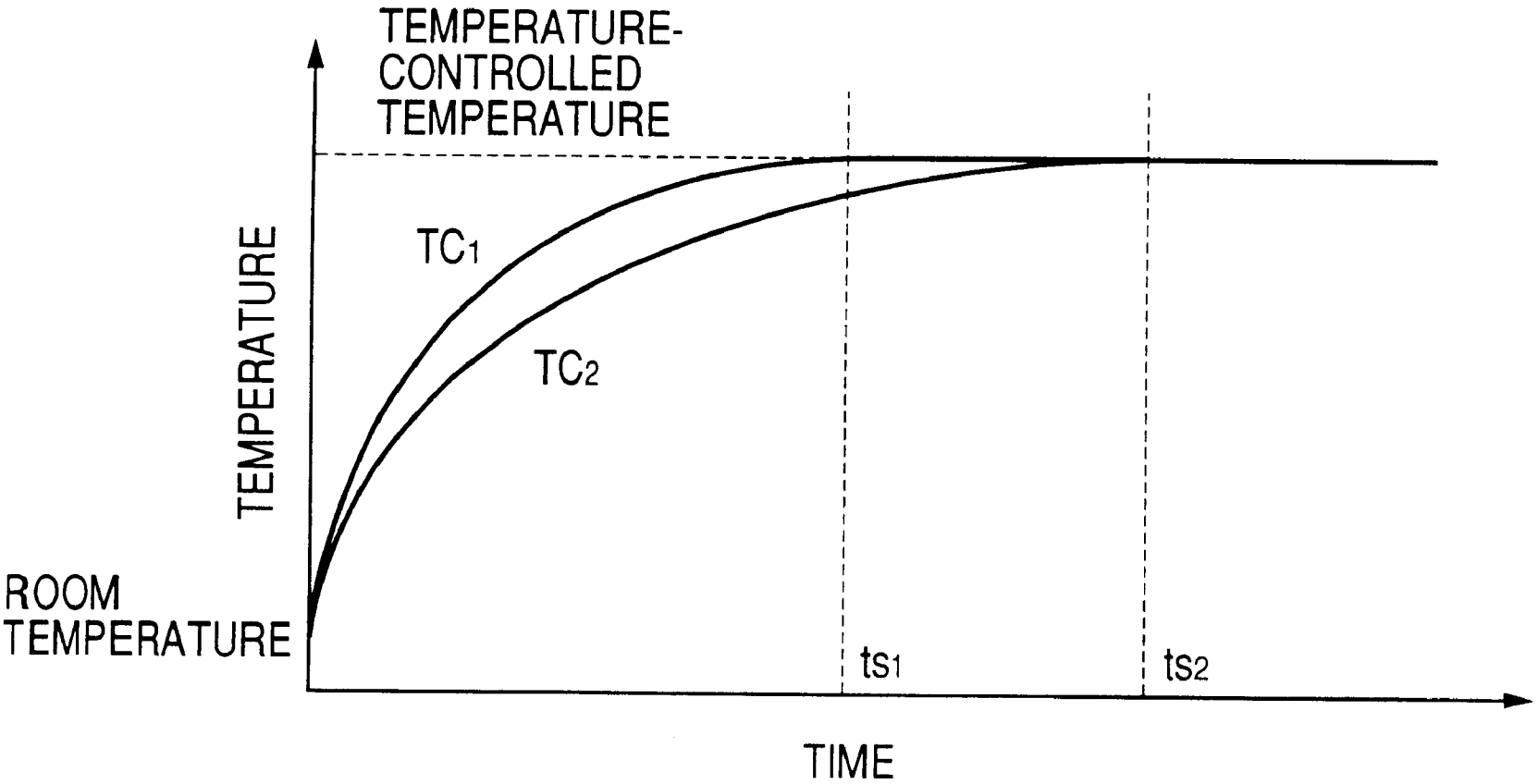
FIG. 12 is a graph showing start-up times of an image heating apparatus.
Figure 13:
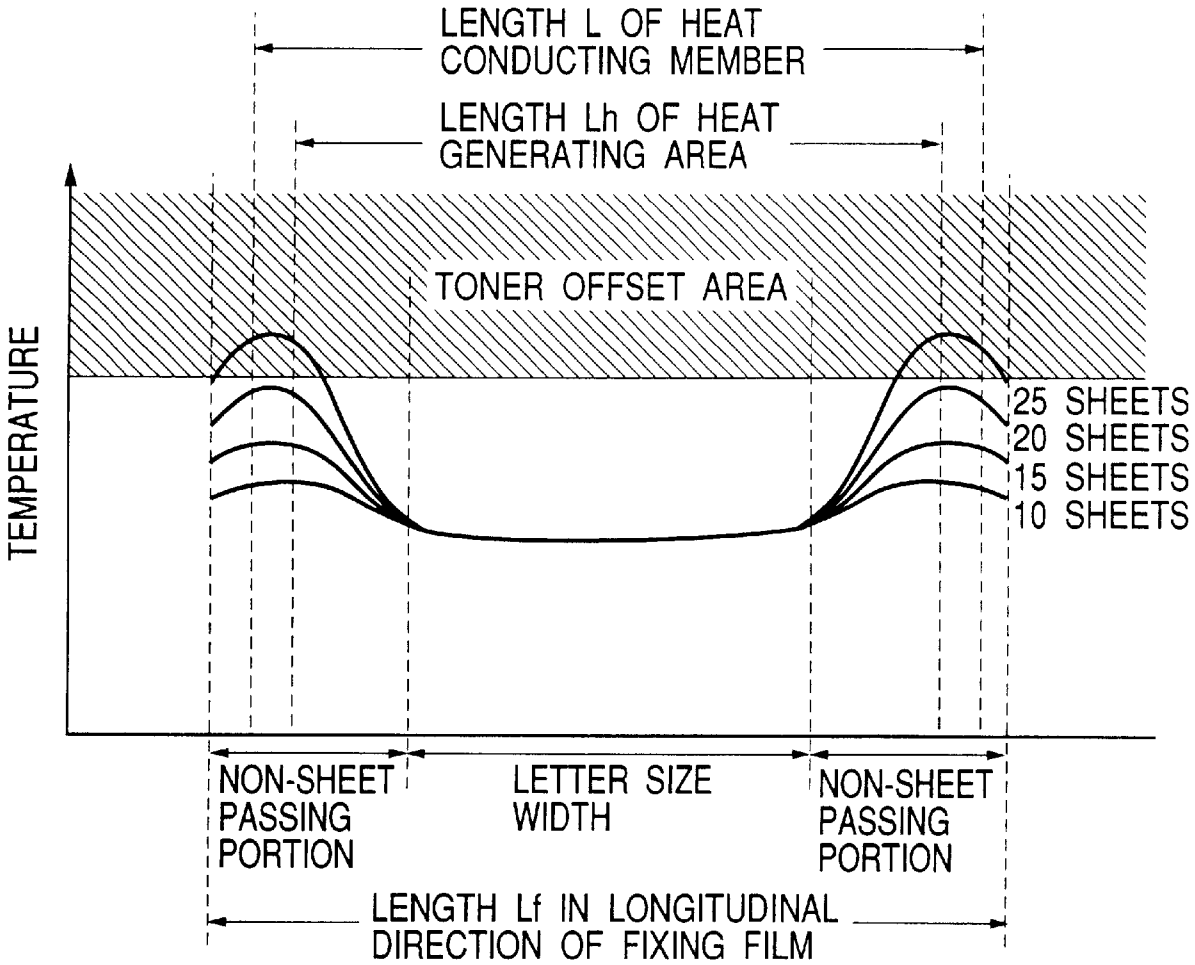
FIG. 13 is a graph showing temperature distributions of rotary members with continuous sheet passing.

<Embodiment 3> (FIG. 11 to FIG. 13)

FIG. 11 is a horizontal sectional model view of a fixing apparatus of this embodiment. In this embodiment, configuring members and portions that are common with those in the apparatus of Embodiment 1 and Embodiment 2 are placed with the same symbols so that repetitious description is omitted.

In Embodiment 1 as well as Embodiment 2, the heat conducting member 17 or 25 is brought into contact with the fixing film 9 so that poor fixing is prevented and simultaneously temperature increase of the non-passing sheet portion at the time when small-size sheet undergoes sheet passing can be reduced.

On the other hand, there is a problem that increase in thermal capacity due to contact by the heat conducting member lengthens time at the time of start-up of the fixing apparatus through to the time when the temperature of the fixing film 9 reaches a predetermined temperature.

In this embodiment, as the heat conducting member, the same aluminum roller 25 as in Embodiment 2 with the thermal conductivity (k=240 [W/m·K]) is disposed in the same position as in Embodiment 2, and in order to solve the above described problem, a spacing mechanism so as to s elect contact of this roller 25 onto the fixing film 9 in accordance with situations is disposed.

The spacing mechanism of the aluminum roller 25 being the heat conducting member toward the fixing film 9, which is omitted in the drawing, can be easily configured by cam mechanism and lever mechanism, etc. with electromagnetic solenoid stepping motor, etc. as a drive power source for example so that a control circuit can implement contact-spacing operation control as desired.

FIG. 12 is a graph showing temperature change in the fixing film 9 as of the beginning of the start-up operation of the fixing apparatus. The temperature change curve $TC_1$ in FIG. 12 is a case where no heat conducting member 25 is provided, and the temperature change curve $TC_2$ is a case where the aluminum roller 25 being a heat conducting member in Embodiment 2 as well as this embodiment is brought into contact with the fixing film 9.

As concerns the time when the temperature reaches a predetermined temperature-controlled temperature of 180° C. in this embodiment from the room temperature, $TC_1$ requires $ts_1$ and $TC_2$ does $ts_2$. In this embodiment, it is necessary to fulfill around $ts_1$=50 sec., and $ts_2$=80 sec. respectively.

Therefore, by bringing the heat conducting member 25 into contact with the fixing film 9, the start-up time of the fixing apparatus by 1.6 times will become necessary.

However, in this embodiment, that has a spacing mechanism of the aluminum roller 25 as a heat conducting member toward the fixing film 9, the aluminum roller 25 is spaced from the fixing film 9 until the temperature of the fixing film reaches the temperature-controlled temperature 180° C.

Thereafter, the aluminum roller 25 being brought into contact with the fixing film 9 after the temperature of the fixing film reaches the temperature-controlled temperature of 180° C., the aluminum roller 25 is heated to an certain extent even under a spaced state and therefore the start-up operation of the fixing apparatus can be completed in approximately time of $ts_1$=50 sec.

After the aluminum roller 25 is brought into contact with the fixing film 9, an effect exactly equivalent to that in Embodiment 2 can be attained.

In addition to what has been described herein, contact or spacing with the fixing film 9 of the aluminum roller 25 can be selected based on the size (width) of the recording material P to undergo sheet passing or the number of sheets which have undergone sheet passing continuously.

In this embodiment, in the case where a small-size sheet undergoes sheet passing, the aluminum roller 25 is not brought into contact with the fixing film 9 but the fixing operation is implemented under a spaced state.

As shown in FIG. 6, when a small-size sheet with a width narrower than the LETTER size undergoes fixing, even if a heat conducting member is not brought into contact with the sheet, thermal drop at the end section of the image in the thermal distribution of the fixing film 9 is comparatively little and is held higher than in the poor fixing region.

Accordingly, the aluminum roller 25 as a heat conducting member, which could be spaced from the fixing film 9, will not cause anxiety that poor fixing should take place.

Under the state where the aluminum roller 25 is brought into contact with the fixing film 9, due to increase in the heat capacity, more power will be consumed in order that the temperature of the fixing film 9 is maintained at a predetermined temperature-controlled temperature, but as described above, in the case where a small-size sheet with a width narrower than the LETTER size undergoes fixing, the aluminum roller 25 should be kept spaced from the fixing film 9 so that any unnecessary power may be prevented from being consumed.

FIG. 13 is to show change of the thermal distribution of the fixing film 9 in relation to the numbers of sheets to undergo sheet passing when LETTER-size recording materials undergo sheet passing at a rate of 15 sheets per minute in the vertical direction with the aluminum roller 25 being left spaced from the fixing film 9.

As the number of sheets to undergo sheet passing increases, the temperature in the non-sheet passing portion of the fixing film 9 rises, which reaches the toner offset region (area) at the time point when 25 sheets have undergone sheet passing.

Immediately thereafter, when an unfixed toner image on a large-size sheet such as A3 size, etc., is fixed, at the end section, toner offset takes place onto the fixing film 9 making a good fixed image unavailable.

However, in contrast, when the number of sheets to undergo sheet passing being LETTER-size recording materials to undergo recording is up to around twenty, the temperature of the non-sheet passing portion of the fixing film 9 does not reach the toner offset region, giving rise to no concerns on the problems as described above.

Therefore in this embodiment, in the case where LETTER-size recording materials undergo sheet passing, until the number of sheets thereof to undergo sheet passing reach twenty, the fixing operation is implemented with the aluminum roller 25 being left spaced from the fixing film 9 so that the quantity of power consumption is limited, and when the number of sheets to undergo sheet passing reach twenty, the aluminum roller 25 is brought into contact with the fixing film 9 so that heat in the non-sheet passing portion of the fixing film 9 is caused to undergo conducting to the sheet passing portion to prevent the temperature in the non-sheet passing portion from reaching the toner offset region.

With the number of sheets which the aluminum roller 25 brings into contact with the fixing film 9 being designated in accordance with sizes of the recording materials so that the temperature of the fixing film in the non-sheet passing portion does not reach the toner offset region at the time when the sheets undergo sheet feeding continuously, reduction in consumption power is possible while preventing the toner offset without causing throughput to drop.

In this embodiment, the aluminum roller 25 as a heat conducting member detects predetermined number of sheet to undergo sheet passing set up in accordance with the recording material P, and is brought into contact with the fixing film 9, but such means that successively detect the fixing film temperature in the non-sheet passing portion, which eventually reaches the temperature set in advance, and that time point, bring the aluminum roller 25 into contact may be adopted.

As described above, by disposing the aluminum roller 25 as a heat conducting member as in FIG. 11, without causing the force necessary to make the fixing film 9 rotate to increase, temperature drop at the end section of the fixing film can be further reduced to prevent poor fixing and simultaneously temperature rise in the non-sheet passing portion at the time when a small-size sheet undergoes sheet passing can be reduced, giving rise to no anxiety of toner offset at the time when a large-size sheet undergoes sheet passing immediately after a small-size sheet has undergone sheet passing so that throughput of a sheet with sizes smaller than those in Embodiment 1 can be increased.

Moreover, provision of the aluminum roller being a heat conducting member with a spacing mechanism can realize reduction in power consumption without hampering the abode-described advantages.

Figure 14:
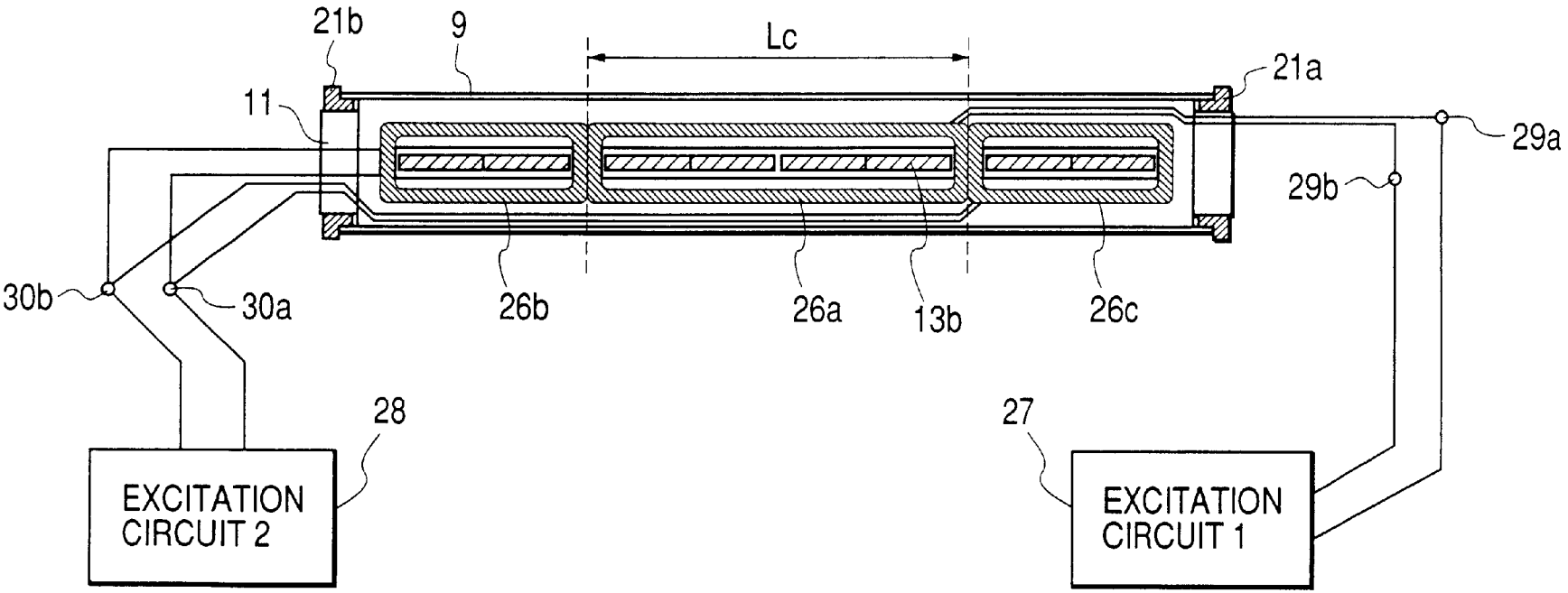
FIG. 14 is a front sectional view showing an image heating apparatus being another embodiment.
Figure 15:
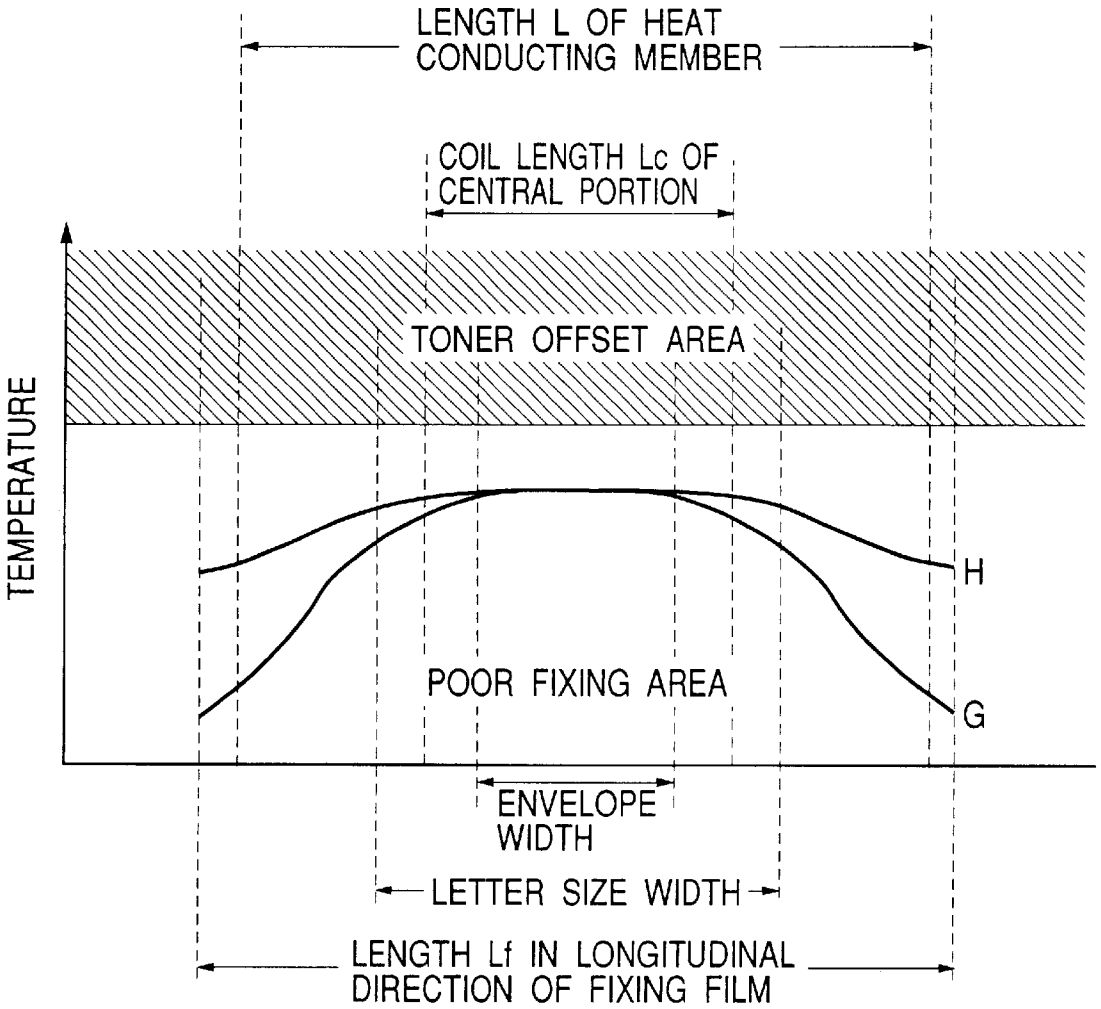
FIG. 15 is a graph showing temperature distributions of rotary.

<Embodiment 4> (FIG. 14 and FIG. 15)

FIG. 14 is a longitudinal sectional model view on a key portion of the fixing apparatus in this embodiment observed from the sheet discharging side. Configuring members and portions that are common with those in Embodiment 1, Embodiment 2, and Embodiment 3 are placed with the same symbols so that repetitious description is omitted.

In the fixing apparatus of this embodiment, the same aluminum (heat conductivity k=240 [W/m·K] roller 25 as that in Embodiment 2 (in FIG. 9) as a heat conducting member is disposed.

In addition, in this embodiment, the excitation coil of the magnetic field generating means is divided into three portions, and as shown in FIG. 14, a central excitation coil 26*a* and excitation coils 26*b* and 26*c* in the end sections are respectively brought into contact with the excitation circuit 1 and the excitation circuit 2 so that the alternate currents (high frequency currents) supplied from respective power sources generate alternate magnetic fluxes.

For a lead (an electric wire) configuring the excitation coils 26*a,* 26*b,* and 26*c* of this embodiment, the same one as in Embodiment 1, Embodiment 2, and Embodiment 3 is used and this undergoes rolling seven times for use.

In this embodiment, in accordance with sizes of the recording material P, in the case where a large-size sheet such as A3 size, etc., undergoes sheet passing, all the excitation coils 26*a,* 26*b,* and 26*c* are caused to generate a magnetic flux, and in the case where A4-size sheet or an envelope undergoes sheet passing, only the central excitation coil 26*a* is caused to generate a magnetic flux.

Such arrangements make it possible that the longitudinal width of the heat generating region H (FIG. 3) of the fixing film 9 varies in accordance with sizes of the recording material P to avoid temperature increase in the non-sheet passing portion at the time when small-size sheet undergoes sheet passing.

In this embodiment, in the case where a recording material with a size not larger than the LETTER size undergoes sheet passing, only central excitation coil 26*a* is caused to generate a magnetic flux, and in the case where a recording material with a size not smaller than the LETTER size undergoes sheet passing, all the excitation coils 26*a,* 26*b,* and 26*c* are caused to generate magnetic fluxes.

In FIG. 15, temperature distribution of the fixing film in the case where the excitation coil is divided into three portions as described above and only the central excitation coil 26*a* is caused to generate the magnetic flux is shown.

The temperature distribution G in FIG. 15 is a temperature distribution when a heat conducting member in order to support heat conduction in the longitudinal direction is not equipped, and the temperature distribution H is the temperature distribution of this embodiment.

In the case where an envelope undergoes sheet passing in the temperature distribution G without any heat conducting member being equipped, the fixing film temperature in the sheet passing region is maintained in the vicinity of the temperature-controlled temperature so that a good fixed image is available. In addition, there is no need to concern much about temperature rise in the non-sheet passing portion since the heat generating region of the fixing film is narrow.

However, in the case where a LETTER-size recording material undergoes sheet passing in the temperature distribution G, the fixing film temperature in the end section of the sheet passing region drops down to poor fixing region and therefore good fixed image is not available.

On the other hand, in the temperature distribution H of this embodiment, the fixing film temperature is maintained in the vicinity of the temperature-controlled temperature in the sheet passing region of the recording materials up to LETTER size (LETTER, A4, and envelopes, etc.) so that a good fixed image is available.

The reason hereof is that the aluminum roller 25 as a heat conducting member can ease temperature grade in the region subject to heating in the fixing film 9.

In addition, it is similar to cases of Embodiment 1, Embodiment 2, and Embodiment 3 that reduction effects of temperature rise in the non-sheet passing portion by way of selecting widths in the heat generating region of the fixing film 9 can be further increased with the aluminum roller 25 being a heat conducting member.

As described above, even in the case where the width of heat generating region is caused to vary in accordance with sizes of recording material, temperature drop of the fixing film at the end portion of an image is caused to be reduced further to prevent poor fixing and simultaneously temperature rise in the non-sheet passing portion at the time when a small-size sheet undergoes sheet passing can be reduced, and thus no toner offsetting can be concerned about when a large-size sheet undergoes sheet passing immediately after when a small-size sheet undergoes sheet passing, and increase in throughput of small-size sheets can be planned.

In this embodiment, control on magnetic flux to change the width of heat generating region of the fixing film is implemented by dividing the excitation coil, but also in the case where other magnetic flux controlling means, for example, magnetic flux cutoff means in which a coil canceling the flux by the excitation coil is disposed at an end section are used, the same effects as described above can be attained.

In addition, as described in Embodiment 3, for reduction of quantity of power consumption a spacing mechanism on the aluminum roller may be provided.

Incidentally, the heat conducting member can be disposed so as to be brought into contact with or be arranged detachably toward the exterior surface of the electromagnetic inductance heat generating rotary body.

In addition, the fixing film 9 as an electromagnetic inductance heat generating rotary body may be configured by apparatus that comprises the one in the form of endless belt being engaged and stretched between or among two or more members and undergoing rotary operation by a pressing roller or driving means other than pressing roller.

In addition, an apparatus in which the magnetic field generating means consisting of excitation coils, etc. are disposed outside the electromagnetic inductance heat generating rotary body will do as well.

In addition, in the present invention, the heating apparatus is not limited to the image heat fixing apparatus of Embodiments, but wide range of such means and apparatus to heat-process the materials to be heated as an image heating apparatus in which a recording material bearing an image undergoes heating and improvement of quality of surface characteristics such as gloss, etc., an image heating apparatus implementing tentative fixing, or otherwise, apparatus to heat-dry the material undergoing heating, and heating-laminating apparatus, etc. are included.

In addition, the pressing member can be the one other than a roller, for example, a rotary body such as a belt member, etc.

In addition, the forming principles and means of a toner image for a recording material are selected arbitrarily.

In addition, the rotary member shall not be limited to films but may be rollers made of metals, etc.

Embodiments of the present invention have been described so far, but the present invention will not be limited to the above described Embodiments in any way, but any variation is feasible within a technological idea of the present invention.

What is claimed is:

1. An image heating apparatus, comprising:

a rotary member;

magnetic flux generating means for generating a magnetic flux; and wherein an eddy current is generated in said rotary member by the magnetic flux generated by said magnetic flux generating means, said rotary member generates heat by the eddy current and an image on a recording material is heated by the heat, a heat conducting member being in contact with said rotary member;

wherein, when, with respect to a direction perpendicular to a moving direction of said rotary member, $L_h$ being a length of a heat generating region of said rotary member, $L_f$ being a length of said rotary member, and L being length of said heat conducting member, $L_h \leqq L \leqq L_f$ is satisfied.

2. An image heating apparatus according to claim 1, wherein said magnetic flux generating means has a coil and length of said heat conducting member with respect to the direction perpendicular to the moving direction of said rotary member is not shorter than length of a region enclosed with said coil.

3. An image heating apparatus according to claim 1, wherein said heat conducting member has a heat conductivity larger than that in said rotary member.

4. An image heating apparatus according to claim 1, wherein said heat conducting member has a heat capacity larger than that in said rotary member.

5. An image heating apparatus according to claim 1, wherein said heat conducting member is in contact with an interior surface of said rotary member.

6. An image heating apparatus according to claim 1, wherein a heat conductivity of said heat conduction member is not less than 70 [W/m·K].

7. An image heating apparatus according to claim 1, wherein said heat conducting member is non-magnetic.

8. An image heating apparatus according to claim 1, wherein said heat conducting member has a plate form.

9. An image heating apparatus according to claim 1, wherein said heat conducting member is a roller.

10. An image heating apparatus according to claim 1, wherein said rotary member is a film having a conductive layer.

11. An image heating apparatus according to claim 1, further comprising a back up member forming a nip with said rotary member, wherein the recording material bearing an unfixed image is sandwiched and conveyed by said nip and the unfixed image is fixed onto the recording material.

* * * * *

UNITED STATES PATENT AND TRADEMARK OFFICE

CERTIFICATE OF CORRECTION

PATENT NO. : 6,298,215 B1
DATED : October 2, 2001
INVENTOR(S) : Takashi Nomura et al.

It is certified that error appears in the above-identified patent and that said Letters Patent is hereby corrected as shown below:

Title page,
Item [57], ABSTRACT, line 9, "respec" should read -- respect --; and
Line 12, "being" should read -- being a --.

Column 1,
Line 44, "filed" should read -- field --.

Column 2,
Line 33, "undergo" should read -- undergoes --; and
Line 53, "to" should read -- to be --.

Column 3,
Line 6, "undergo" should read -- undergoes --;
Line 7, "past" should read -- passed --;
Line 63, "is" should read -- is a --; and
Line 65, "is" should read -- is a --.

Column 4,
Line 1, "is" should read -- is a --.

Column 6,
Line 12, "emitted" should read -- emitted to --;
Line 15, "that" should read -- than --;
Line 22, "are" should read -- is --; and
Line 53, "causes" should be deleted.

Column 7,
Line 36, "a one" should read -- one --.

Column 8,
Line 22, "gets" should read -- get --;
Line 25, "this" should read -- this --; and
Line 41, "that" should be deleted.

Column 9,
Line 26, "get no longer" should read -- no longer be --;
Line 46, "not" should read -- not be --; and
Line 51, "with not" should read -- not with --.

UNITED STATES PATENT AND TRADEMARK OFFICE

CERTIFICATE OF CORRECTION

PATENT NO. : 6,298,215 B1
DATED : October 2, 2001
INVENTOR(S) : Takashi Nomura et al.

It is certified that error appears in the above-identified patent and that said Letters Patent is hereby corrected as shown below:

Column 10,
Line 25, "pass" should read -- passes --;
Line 51, "appear remarkably." should read -- remarkably appear. --;
Line 58, "undergo" should read -- undergoes --.

Column 11,
Line 49, "is" should read -- is a --.

Column 12,
Line 1, "filed" should read -- field --;
Line 53, "case" should read -- case of --; and
Line 67, "start" should read -- starts --.

Column 13,
Line 2, "to" (first occurrence) should read -- to be --;
Line 23, "$L \leqq L_h$" should read -- $L \geqq L_h$ -- ;and
Line 45, "not" should read -- not be --;

Column 14,
Line 35, "undergo" should read -- undergoes --;
Line 48, "25." should read -- 25 --; and
Line 54, "to concern" should read -- to be concerned --.

Column 15,
Line 4, "when" should read -- when a --;
Line 15, "s" should be deleted;
Line 16, "elect" should read -- select --; and
Line 53, "time" should read -- a time --.

Column 16 ,
Line 60, "detect" should read -- detects a -- and "sheet" should read -- sheets --; and
Line 67, "may" should read -- and may --.

Column 17,
Line 15, "abode-described" should read -- above-described --.

Column 18,
Line 6, "to concern" should read -- to be concerned --.

UNITED STATES PATENT AND TRADEMARK OFFICE

CERTIFICATE OF CORRECTION

PATENT NO. : 6,298,215 B1
DATED : October 2, 2001
INVENTOR(S) : Takashi Nomura et al.

It is certified that error appears in the above-identified patent and that said Letters Patent is hereby corrected as shown below:

Column 19,
Line 25, "flux;" should read -- flux, --;
Line 30, "heat," should read -- heat; and --; and
Line 32, "member;" should read -- member, --.

Column 20,
Line 1, "being" should read -- being a --.

Signed and Sealed this

Twenty-first Day of May, 2002

*Attest:*

*Attesting Officer*

JAMES E. ROGAN
*Director of the United States Patent and Trademark Office*